US009175458B2

(12) United States Patent
Meehan et al.

(10) Patent No.: US 9,175,458 B2
(45) Date of Patent: Nov. 3, 2015

(54) FAUCET INCLUDING A PULLOUT WAND WITH A CAPACITIVE SENSING

(71) Applicant: Masco Corporation of Indiana, Indianapolis, IN (US)

(72) Inventors: Steven Kyle Meehan, Fishers, IN (US); Joel D Sawaski, Indianapolis, IN (US); Greg F Bellamah, Cincinnati, OH (US)

(73) Assignee: Delta Faucet Company, Indianapolis, IN (US)

( * ) Notice: Subject to any disclaimer, the term of this patent is extended or adjusted under 35 U.S.C. 154(b) by 313 days.

(21) Appl. No.: 13/866,462

(22) Filed: Apr. 19, 2013

(65) Prior Publication Data

US 2013/0276911 A1 Oct. 24, 2013

Related U.S. Application Data

(60) Provisional application No. 61/636,373, filed on Apr. 20, 2012.

(51) Int. Cl.
*E03C 1/04* (2006.01)
*E03C 1/05* (2006.01)

(52) U.S. Cl.
CPC . *E03C 1/04* (2013.01); *E03C 1/055* (2013.01); *E03C 2001/0415* (2013.01); *Y10T 137/6918* (2015.04)

(58) Field of Classification Search
CPC . F16K 19/006; F16K 27/044; F24D 17/0078; H02N 2/023; A46B 15/0004; A46B 15/0051; A46B 15/0055; A46B 7/04; A61B 5/0871; A61B 5/6896; E03C 1/055; E03C 1/057; E03C 1/04; E03C 1/0404; E03C 2001/0415; G05D 23/1393; G05D 23/1353; Y10T 137/6918; Y10T 137/9464; Y10T 137/87571; Y10T 137/87917; Y10T 137/8807
USPC ..... 137/602, 603, 613, 615, 355.16, 801
See application file for complete search history.

(56) References Cited

U.S. PATENT DOCUMENTS

| | | | |
|---|---|---|---|
| 2,337,321 | A | 12/1943 | Freeman |
| 2,991,481 | A | 7/1961 | Book |
| 3,081,594 | A | 3/1963 | Atkins et al. |
| 3,151,340 | A | 10/1964 | Teshima |
| 3,254,313 | A | 5/1966 | Atkins et al. |
| 3,314,081 | A | 4/1967 | Atkins et al. |
| 3,406,941 | A | 10/1968 | Ichimori et al. |

(Continued)

FOREIGN PATENT DOCUMENTS

| | | | |
|---|---|---|---|
| CA | 2492226 | A1 | 7/2005 |
| CN | 101563561 | | 10/2009 |

(Continued)

OTHER PUBLICATIONS

KWC AG, Kitchen Faucet 802285 Installation and Service Instructions, dated Jul. 2005, 8 pgs.

(Continued)

*Primary Examiner* — Craig Schneider
*Assistant Examiner* — Craig J Price
(74) *Attorney, Agent, or Firm* — Faegre Baker Daniels LLP

(57) ABSTRACT

An electronic faucet including a spout hub and a pullout wand removably coupled to the spout hub. The pullout wand is touch sensitive when docked to the spout hub, and is not touch sensitive when undocked from the spout hub.

24 Claims, 16 Drawing Sheets

(56) References Cited

U.S. PATENT DOCUMENTS

| | | | |
|---|---|---|---|
| 3,588,038 | A | 6/1971 | Tanaka |
| 3,651,989 | A | 3/1972 | Westrich |
| 3,672,479 | A | 6/1972 | Schwertfeger et al. |
| 3,685,541 | A | 8/1972 | Braucksick et al. |
| 3,705,574 | A | 12/1972 | Duncan |
| 3,756,456 | A | 9/1973 | Georgi |
| 3,762,440 | A | 10/1973 | Bryant |
| 3,799,171 | A | 3/1974 | Patel |
| 3,987,819 | A | 10/1976 | Scheuermann |
| 4,172,381 | A | 10/1979 | Aigner |
| 4,185,336 | A | 1/1980 | Young |
| 4,200,018 | A | 4/1980 | Sekiwa |
| 4,201,518 | A | 5/1980 | Stevenson |
| 4,280,530 | A | 7/1981 | Yi |
| 4,331,292 | A | 5/1982 | Zimmer |
| 4,337,388 | A | 6/1982 | July |
| 4,359,186 | A | 11/1982 | Kiendl |
| 4,406,313 | A | 9/1983 | Bennett et al. |
| 4,407,444 | A | 10/1983 | Knebel et al. |
| 4,409,694 | A | 10/1983 | Barrett et al. |
| 4,410,791 | A | 10/1983 | Eastep |
| 4,420,811 | A | 12/1983 | Tarnay et al. |
| 4,421,269 | A | 12/1983 | Ts'ao |
| 4,424,767 | A | 1/1984 | Wicke et al. |
| 4,429,422 | A | 2/1984 | Wareham |
| 4,436,983 | A | 3/1984 | Solobay |
| 4,439,669 | A | 3/1984 | Ryffel |
| 4,450,829 | A | 5/1984 | Morita et al. |
| 4,459,465 | A | 7/1984 | Knight |
| 4,503,575 | A | 3/1985 | Knoop et al. |
| 4,532,962 | A | 8/1985 | Campau |
| 4,537,348 | A | 8/1985 | Gossi |
| 4,541,562 | A | 9/1985 | Zukausky |
| 4,554,688 | A | 11/1985 | Puccerella |
| 4,563,780 | A | 1/1986 | Pollack |
| 4,567,350 | A | 1/1986 | Todd, Jr. |
| 4,581,707 | A | 4/1986 | Millar |
| 4,584,463 | A | 4/1986 | Klages et al. |
| 4,604,515 | A | 8/1986 | Davidson |
| 4,604,764 | A | 8/1986 | Enzo |
| 4,606,325 | A | 8/1986 | Lujan |
| 4,611,757 | A | 9/1986 | Saether |
| 4,628,902 | A | 12/1986 | Comber |
| 4,638,147 | A | 1/1987 | Dytch et al. |
| 4,674,678 | A | 6/1987 | Knebel et al. |
| 4,680,446 | A | 7/1987 | Post |
| 4,682,581 | A | 7/1987 | Laing et al. |
| 4,682,728 | A | 7/1987 | Oudenhoven et al. |
| 4,688,277 | A | 8/1987 | Kakinoki et al. |
| 4,693,415 | A | 9/1987 | Sturm |
| 4,700,884 | A | 10/1987 | Barrett et al. |
| 4,700,885 | A | 10/1987 | Knebel |
| 4,709,728 | A | 12/1987 | Ying-Chung |
| 4,713,525 | A | 12/1987 | Eastep |
| 4,735,357 | A | 4/1988 | Gregory et al. |
| 4,738,280 | A | 4/1988 | Oberholtzer |
| 4,742,456 | A | 5/1988 | Kamena |
| 4,750,472 | A | 6/1988 | Fazekas |
| 4,753,265 | A | 6/1988 | Barrett et al. |
| 4,756,030 | A | 7/1988 | Juliver |
| 4,757,943 | A | 7/1988 | Sperling et al. |
| 4,768,705 | A | 9/1988 | Tsutsui et al. |
| 4,786,782 | A | 11/1988 | Takai et al. |
| 4,798,224 | A | 1/1989 | Haws |
| 4,808,793 | A | 2/1989 | Hurko |
| 4,832,259 | A | 5/1989 | Vandermeyden |
| 4,854,498 | A | 8/1989 | Stayton |
| 4,869,287 | A | 9/1989 | Pepper et al. |
| 4,869,427 | A | 9/1989 | Kawamoto et al. |
| 4,870,986 | A | 10/1989 | Barrett et al. |
| 4,872,485 | A | 10/1989 | Laverty |
| 4,875,623 | A | 10/1989 | Garris |
| 4,893,653 | A | 1/1990 | Ferrigno |
| 4,896,658 | A | 1/1990 | Yonekubo et al. |
| 4,901,915 | A | 2/1990 | Sakakibara |
| 4,909,435 | A | 3/1990 | Kidouchi et al. |
| 4,914,758 | A | 4/1990 | Shaw |
| 4,916,613 | A | 4/1990 | Lange et al. |
| 4,917,142 | A | 4/1990 | Laing et al. |
| 4,923,116 | A | 5/1990 | Homan |
| 4,930,551 | A | 6/1990 | Haws |
| 4,936,289 | A | 6/1990 | Peterson |
| 4,936,508 | A | 6/1990 | Ingalz |
| 4,941,608 | A | 7/1990 | Shimizu et al. |
| 4,945,942 | A | 8/1990 | Lund |
| 4,945,943 | A | 8/1990 | Cogger |
| 4,955,535 | A | 9/1990 | Tsutsui et al. |
| 4,965,894 | A | 10/1990 | Baus |
| 4,967,794 | A | 11/1990 | Tsutsui et al. |
| 4,969,598 | A | 11/1990 | Garris |
| 4,970,373 | A | 11/1990 | Lutz et al. |
| 4,971,106 | A | 11/1990 | Tsutsui et al. |
| 4,998,673 | A | 3/1991 | Pilolla |
| 5,009,572 | A | 4/1991 | Imhoff et al. |
| 5,020,127 | A | 5/1991 | Eddas et al. |
| 5,033,508 | A | 7/1991 | Laverty |
| 5,033,715 | A | 7/1991 | Chiang |
| 5,040,106 | A | 8/1991 | Maag |
| 5,042,524 | A | 8/1991 | Lund |
| 5,056,712 | A | 10/1991 | Enck |
| 5,057,214 | A | 10/1991 | Morris |
| 5,058,804 | A | 10/1991 | Yonekubo et al. |
| 5,063,955 | A | 11/1991 | Sakakibara |
| 5,086,526 | A | 2/1992 | Van Marcke |
| 5,095,945 | A | 3/1992 | Jensen |
| 5,105,846 | A | 4/1992 | Britt |
| 5,124,934 | A | 6/1992 | Kawamoto et al. |
| 5,125,433 | A | 6/1992 | DeMoss et al. |
| 5,129,034 | A | 7/1992 | Sydenstricker |
| 5,133,089 | A | 7/1992 | Tsutsui et al. |
| 5,139,044 | A | 8/1992 | Otten et al. |
| 5,143,049 | A | 9/1992 | Laing et al. |
| 5,148,824 | A | 9/1992 | Wilson et al. |
| 5,170,361 | A | 12/1992 | Reed |
| 5,170,514 | A | 12/1992 | Weigert |
| 5,170,816 | A | 12/1992 | Schnieders |
| 5,170,944 | A | 12/1992 | Shirai |
| 5,174,495 | A | 12/1992 | Eichholz et al. |
| 5,175,892 | A | 1/1993 | Shaw |
| 5,183,029 | A | 2/1993 | Ranger |
| 5,184,642 | A | 2/1993 | Powell |
| 5,187,816 | A | 2/1993 | Chiou |
| 5,202,666 | A | 4/1993 | Knippscheer |
| 5,205,318 | A | 4/1993 | Massaro et al. |
| 5,206,963 | A | 5/1993 | Wiens |
| 5,217,035 | A | 6/1993 | Van Marcke |
| 5,224,509 | A | 7/1993 | Tanaka et al. |
| 5,226,629 | A | 7/1993 | Millman et al. |
| 5,261,443 | A | 11/1993 | Walsh |
| 5,262,621 | A | 11/1993 | Hu et al. |
| 5,265,318 | A | 11/1993 | Shero |
| 5,277,219 | A | 1/1994 | Lund |
| 5,287,570 | A | 2/1994 | Peterson et al. |
| 5,315,719 | A | 5/1994 | Tsutsui et al. |
| 5,323,803 | A | 6/1994 | Blumenauer |
| 5,325,822 | A | 7/1994 | Fernandez |
| 5,334,819 | A | 8/1994 | Lin |
| 5,341,839 | A | 8/1994 | Kobayashi et al. |
| 5,348,231 | A | 9/1994 | Arnold et al. |
| 5,351,712 | A | 10/1994 | Houlihan |
| 5,358,177 | A | 10/1994 | Cashmore |
| 5,361,215 | A | 11/1994 | Tompkins et al. |
| 5,362,026 | A | 11/1994 | Kobayashi et al. |
| 5,385,168 | A | 1/1995 | Lund |
| 5,400,961 | A | 3/1995 | Tsutsui et al. |
| 5,408,578 | A | 4/1995 | Bolivar |
| 5,409,037 | A | 4/1995 | Wheeler et al. |
| 5,419,930 | A | 5/1995 | Schucker |
| 5,429,272 | A | 7/1995 | Luigi |
| 5,431,302 | A | 7/1995 | Tulley et al. |
| 5,433,342 | A | 7/1995 | Luro |
| 5,437,003 | A | 7/1995 | Blanco |
| RE35,018 | E | 8/1995 | Homan |
| 5,438,642 | A | 8/1995 | Posen |

(56) References Cited

U.S. PATENT DOCUMENTS

| | | | |
|---|---|---|---|
| 5,467,967 | A | 11/1995 | Gillooly |
| 5,479,558 | A | 12/1995 | White et al. |
| 5,482,250 | A | 1/1996 | Kodaira |
| 5,504,306 | A | 4/1996 | Russell et al. |
| 5,504,950 | A | 4/1996 | Natalizia et al. |
| 5,511,579 | A | 4/1996 | Price |
| 5,511,723 | A | 4/1996 | Eki et al. |
| 5,540,555 | A | 7/1996 | Corso et al. |
| 5,550,753 | A | 8/1996 | Tompkins et al. |
| 5,564,462 | A | 10/1996 | Storch |
| 5,566,702 | A | 10/1996 | Philipp |
| 5,570,869 | A | 11/1996 | Diaz et al. |
| 5,572,985 | A | 11/1996 | Benham |
| 5,575,424 | A | 11/1996 | Fleischmann |
| 5,577,660 | A | 11/1996 | Hansen |
| 5,584,316 | A | 12/1996 | Lund |
| 5,586,572 | A | 12/1996 | Lund |
| 5,588,636 | A | 12/1996 | Eichholz et al. |
| 5,595,342 | A | 1/1997 | McNair et al. |
| 5,603,344 | A | 2/1997 | Hall |
| 5,610,589 | A | 3/1997 | Evans et al. |
| 5,622,203 | A | 4/1997 | Givler et al. |
| 5,623,990 | A | 4/1997 | Pirkle |
| 5,627,375 | A | 5/1997 | Hsieh |
| 5,682,032 | A | 10/1997 | Philipp |
| 5,694,653 | A | 12/1997 | Harald |
| 5,730,165 | A | 3/1998 | Philipp |
| 5,735,291 | A | 4/1998 | Kaonohi |
| 5,758,688 | A | 6/1998 | Hamanaka et al. |
| 5,769,120 | A | 6/1998 | Laverty et al. |
| 5,775,372 | A | 7/1998 | Houlihan |
| 5,784,531 | A | 7/1998 | Mann et al. |
| 5,790,024 | A | 8/1998 | Ripingill et al. |
| 5,812,059 | A | 9/1998 | Shaw et al. |
| 5,813,655 | A | 9/1998 | Pinchott et al. |
| 5,819,366 | A | 10/1998 | Edin |
| 5,823,229 | A | 10/1998 | Bertrand et al. |
| 5,829,467 | A | 11/1998 | Spicher |
| 5,829,475 | A | 11/1998 | Acker |
| 5,845,844 | A | 12/1998 | Zosimodis |
| 5,855,356 | A | 1/1999 | Fait |
| 5,857,717 | A | 1/1999 | Caffrey |
| 5,868,311 | A | 2/1999 | Cretu-Petra |
| 5,872,891 | A | 2/1999 | Son |
| 5,941,275 | A | 8/1999 | Laing |
| 5,944,221 | A | 8/1999 | Laing et al. |
| 5,961,095 | A | 10/1999 | Schrott |
| 5,963,624 | A | 10/1999 | Pope |
| 5,966,753 | A | 10/1999 | Gauthier et al. |
| 5,979,776 | A | 11/1999 | Williams |
| 5,983,922 | A | 11/1999 | Laing et al. |
| 6,000,170 | A | 12/1999 | Davis |
| 6,003,170 | A | 12/1999 | Humpert et al. |
| 6,003,182 | A | 12/1999 | Song |
| 6,006,784 | A | 12/1999 | Tsutsui et al. |
| 6,019,130 | A | 2/2000 | Rump |
| 6,026,844 | A | 2/2000 | Laing et al. |
| 6,029,094 | A | 2/2000 | Diffut |
| 6,032,616 | A | 3/2000 | Jones |
| 6,042,885 | A | 3/2000 | Woollard et al. |
| 6,061,499 | A | 5/2000 | Hlebovy |
| 6,075,454 | A | 6/2000 | Yamasaki |
| 6,085,790 | A | 7/2000 | Humpert et al. |
| 6,093,313 | A | 7/2000 | Bovaird et al. |
| 6,101,452 | A | 8/2000 | Krall et al. |
| 6,132,085 | A | 10/2000 | Bergeron |
| 6,167,845 | B1 | 1/2001 | Decker, Sr. |
| 6,175,689 | B1 | 1/2001 | Blanco, Jr. |
| 6,182,683 | B1 | 2/2001 | Sisk |
| 6,192,192 | B1 | 2/2001 | Illy et al. |
| 6,196,065 | B1 | 3/2001 | Henksmeier et al. |
| 6,202,980 | B1 | 3/2001 | Vincent et al. |
| 6,227,235 | B1 | 5/2001 | Laing et al. |
| 6,240,250 | B1 | 5/2001 | Blanco, Jr. |
| 6,250,558 | B1 | 6/2001 | Dogre Cuevas |
| 6,250,601 | B1 | 6/2001 | Kolar et al. |
| 6,273,394 | B1 | 8/2001 | Vincent et al. |
| 6,283,139 | B1 | 9/2001 | Symonds et al. |
| 6,286,764 | B1 | 9/2001 | Garvey et al. |
| 6,288,707 | B1 | 9/2001 | Philipp |
| 6,290,139 | B1 | 9/2001 | Kolze |
| 6,290,147 | B1 | 9/2001 | Bertrand et al. |
| 6,294,786 | B1 | 9/2001 | Marcichow et al. |
| 6,315,208 | B1 | 11/2001 | Doyle |
| 6,317,717 | B1 | 11/2001 | Lindsey et al. |
| 6,321,785 | B1 | 11/2001 | Bergmann |
| 6,337,635 | B1 | 1/2002 | Ericksen et al. |
| 6,340,032 | B1 | 1/2002 | Zosimadis |
| 6,341,389 | B2 | 1/2002 | Philipps-Liebich et al. |
| 6,351,603 | B2 | 2/2002 | Waithe et al. |
| 6,363,549 | B2 | 4/2002 | Humpert et al. |
| 6,370,713 | B2 | 4/2002 | Bosio |
| 6,377,009 | B1 | 4/2002 | Philipp |
| 6,389,226 | B1 | 5/2002 | Neale et al. |
| 6,438,770 | B1 | 8/2002 | Hed et al. |
| 6,445,306 | B1 | 9/2002 | Trovato et al. |
| 6,446,875 | B1 | 9/2002 | Brooks et al. |
| 6,452,514 | B1 | 9/2002 | Philipp |
| RE37,888 | E | 10/2002 | Cretu-Petra |
| 6,457,355 | B1 | 10/2002 | Philipp |
| 6,466,036 | B1 | 10/2002 | Philipp |
| 6,473,917 | B1 | 11/2002 | Mateina |
| 6,474,951 | B2 | 11/2002 | Stephan et al. |
| 6,513,787 | B1 | 2/2003 | Jeromson et al. |
| 6,522,078 | B1 | 2/2003 | Okamoto et al. |
| 6,535,200 | B2 | 3/2003 | Philipp |
| 6,536,464 | B1 | 3/2003 | Lum et al. |
| 6,549,816 | B2 | 4/2003 | Gauthier et al. |
| 6,574,426 | B1 | 6/2003 | Blanco, Jr. |
| 6,588,377 | B1 | 7/2003 | Leary et al. |
| 6,598,245 | B2 | 7/2003 | Nishioka |
| 6,612,267 | B1 | 9/2003 | West |
| 6,619,320 | B2 | 9/2003 | Parsons |
| 6,619,567 | B1 | 9/2003 | Ouyoung |
| 6,622,930 | B2 | 9/2003 | Laing et al. |
| 6,629,645 | B2 | 10/2003 | Mountford et al. |
| 6,639,209 | B1 | 10/2003 | Patterson et al. |
| 6,644,333 | B2 | 11/2003 | Gloodt |
| 6,659,048 | B1 | 12/2003 | DeSantis et al. |
| 6,676,024 | B1 | 1/2004 | McNerney et al. |
| 6,684,822 | B1 | 2/2004 | Lieggi |
| 6,691,338 | B2 | 2/2004 | Zieger |
| 6,705,534 | B1 | 3/2004 | Mueller |
| 6,707,030 | B1 | 3/2004 | Watson |
| 6,734,685 | B2 | 5/2004 | Rudrich |
| 6,757,921 | B2 | 7/2004 | Esche |
| 6,768,103 | B2 | 7/2004 | Watson |
| 6,770,869 | B2 | 8/2004 | Patterson et al. |
| 6,779,552 | B1 | 8/2004 | Coffman |
| 6,874,535 | B2 | 4/2005 | Parsons et al. |
| 6,877,172 | B2 | 4/2005 | Malek et al. |
| 6,892,952 | B2 | 5/2005 | Chang et al. |
| 6,895,985 | B2 | 5/2005 | Popper et al. |
| 6,913,203 | B2 | 7/2005 | DeLangis |
| 6,955,333 | B2 | 10/2005 | Patterson et al. |
| 6,956,498 | B1 | 10/2005 | Gauthier et al. |
| 6,962,162 | B2 | 11/2005 | Acker |
| 6,962,168 | B2 | 11/2005 | McDaniel et al. |
| 6,964,404 | B2 | 11/2005 | Patterson et al. |
| 6,964,405 | B2 | 11/2005 | Marcichow et al. |
| 6,968,860 | B1 | 11/2005 | Haenlein et al. |
| 6,993,607 | B2 | 1/2006 | Philipp |
| 7,025,077 | B2 | 4/2006 | Vogel |
| 7,069,941 | B2 | 7/2006 | Parsons et al. |
| 7,070,125 | B2 | 7/2006 | Williams et al. |
| 7,096,517 | B2 | 8/2006 | Gubeli et al. |
| 7,099,649 | B2 | 8/2006 | Patterson et al. |
| D528,991 | S | 9/2006 | Katsuyama et al. |
| 7,150,293 | B2 | 12/2006 | Jonte |
| 7,174,577 | B2 | 2/2007 | Jost et al. |
| 7,232,111 | B2 | 6/2007 | McDaniel et al. |
| 7,295,190 | B2 | 11/2007 | Philipp |
| 7,380,731 | B1 | 6/2008 | Hsu |
| 7,537,023 | B2 | 5/2009 | Marty et al. |

(56) References Cited

U.S. PATENT DOCUMENTS

| | | | |
|---|---|---|---|
| 7,537,195 | B2 | 5/2009 | McDaniel et al. |
| 7,627,909 | B2 | 12/2009 | Esche |
| 7,690,395 | B2 | 4/2010 | Jonte et al. |
| 7,753,074 | B2 | 7/2010 | Rosko et al. |
| 7,766,043 | B2 | 8/2010 | Thomas et al. |
| 7,997,301 | B2 | 8/2011 | Marty et al. |
| 8,028,355 | B2 | 10/2011 | Reeder et al. |
| 8,118,240 | B2 | 2/2012 | Rodenbeck et al. |
| 8,162,236 | B2 | 4/2012 | Rodenbeck et al. |
| 8,365,767 | B2 | 2/2013 | Davidson et al. |
| 8,561,626 | B2 | 10/2013 | Sawaski et al. |
| 8,776,817 | B2 * | 7/2014 | Sawaski et al. ..... 137/1 |
| 8,939,429 | B2 * | 1/2015 | Sawaski et al. ..... 251/129.04 |
| 8,944,105 | B2 * | 2/2015 | Rodenbeck et al. ..... 137/801 |
| 2001/0022352 | A1 | 9/2001 | Rudrich |
| 2002/0007510 | A1 | 1/2002 | Mann |
| 2002/0015024 | A1 | 2/2002 | Westerman et al. |
| 2002/0113134 | A1 | 8/2002 | Laing et al. |
| 2002/0117122 | A1 | 8/2002 | Lindner |
| 2002/0148040 | A1 | 10/2002 | Mateina |
| 2002/0179723 | A1 | 12/2002 | Wack et al. |
| 2003/0080194 | A1 | 5/2003 | O'Hara et al. |
| 2003/0088338 | A1 | 5/2003 | Phillips et al. |
| 2003/0089399 | A1 | 5/2003 | Acker |
| 2003/0125842 | A1 | 7/2003 | Chang et al. |
| 2003/0126993 | A1 | 7/2003 | Lassota et al. |
| 2003/0185548 | A1 | 10/2003 | Novotny et al. |
| 2003/0213062 | A1 | 11/2003 | Honda et al. |
| 2004/0011399 | A1 | 1/2004 | Segien, Jr. |
| 2004/0041033 | A1 | 3/2004 | Kemp |
| 2004/0041034 | A1 | 3/2004 | Kemp |
| 2004/0061685 | A1 | 4/2004 | Ostergard et al. |
| 2004/0135010 | A1 | 7/2004 | Malek et al. |
| 2004/0149643 | A1 | 8/2004 | Vandenbelt et al. |
| 2004/0155116 | A1 | 8/2004 | Wack et al. |
| 2004/0206405 | A1 | 10/2004 | Smith et al. |
| 2004/0212599 | A1 | 10/2004 | Cok et al. |
| 2004/0262552 | A1 | 12/2004 | Lowe |
| 2005/0001046 | A1 | 1/2005 | Laing |
| 2005/0006402 | A1 | 1/2005 | Acker |
| 2005/0022871 | A1 | 2/2005 | Acker |
| 2005/0086958 | A1 | 4/2005 | Walsh |
| 2005/0117912 | A1 | 6/2005 | Patterson et al. |
| 2005/0121529 | A1 | 6/2005 | DeLangis |
| 2005/0125083 | A1 | 6/2005 | Kiko |
| 2005/0127313 | A1 | 6/2005 | Watson |
| 2005/0133100 | A1 | 6/2005 | Bolderheij et al. |
| 2005/0150552 | A1 | 7/2005 | Forshey |
| 2005/0150556 | A1 | 7/2005 | Jonte |
| 2005/0151101 | A1 | 7/2005 | McDaniel et al. |
| 2005/0194399 | A1 | 9/2005 | Proctor |
| 2005/0199843 | A1 | 9/2005 | Jost et al. |
| 2005/0273218 | A1 | 12/2005 | Breed et al. |
| 2006/0066991 | A1 | 3/2006 | Hirano et al. |
| 2006/0101575 | A1 | 5/2006 | Louis |
| 2006/0130907 | A1 | 6/2006 | Marty et al. |
| 2006/0130908 | A1 | 6/2006 | Marty et al. |
| 2006/0138246 | A1 | 6/2006 | Stowe et al. |
| 2006/0153165 | A1 | 7/2006 | Beachy |
| 2006/0186215 | A1 | 8/2006 | Logan |
| 2006/0200903 | A1 | 9/2006 | Rodenbeck et al. |
| 2006/0201558 | A1 | 9/2006 | Marty et al. |
| 2006/0202142 | A1 | 9/2006 | Marty et al. |
| 2006/0212016 | A1 | 9/2006 | Lavon et al. |
| 2006/0231638 | A1 | 10/2006 | Belz et al. |
| 2006/0231788 | A1 | 10/2006 | Cheng |
| 2006/0238428 | A1 | 10/2006 | Schmitt et al. |
| 2006/0238513 | A1 | 10/2006 | Philipp |
| 2006/0283511 | A1 | 12/2006 | Nelson |
| 2007/0001018 | A1 | 1/2007 | Schmitt et al. |
| 2007/0057215 | A1 | 3/2007 | Parsons et al. |
| 2007/0069168 | A1 | 3/2007 | Jonte |
| 2007/0157978 | A1 | 7/2007 | Jonte et al. |
| 2007/0235672 | A1 | 10/2007 | McDaniel et al. |
| 2007/0246267 | A1 | 10/2007 | Koottungal |
| 2007/0246550 | A1 | 10/2007 | Rodenbeck et al. |
| 2007/0246564 | A1 | 10/2007 | Rodenbeck et al. |
| 2008/0099045 | A1 | 5/2008 | Glenn et al. |
| 2008/0111090 | A1 | 5/2008 | Schmitt |
| 2008/0178950 | A1 | 7/2008 | Marty et al. |
| 2008/0178957 | A1 | 7/2008 | Thomas et al. |
| 2008/0189850 | A1 | 8/2008 | Seggio et al. |
| 2008/0203195 | A1 | 8/2008 | Schmitt |
| 2008/0271238 | A1 | 11/2008 | Reeder et al. |
| 2009/0039176 | A1 | 2/2009 | Davidson et al. |
| 2010/0012194 | A1 | 1/2010 | Jonte et al. |
| 2010/0044604 | A1 | 2/2010 | Burke et al. |
| 2010/0096017 | A1 | 4/2010 | Jonte et al. |
| 2010/0108165 | A1 | 5/2010 | Rodenbeck et al. |
| 2010/0170570 | A1 | 7/2010 | Rodenbeck et al. |
| 2010/0294641 | A1 | 11/2010 | Kunkel |
| 2011/0016625 | A1 | 1/2011 | Marty et al. |
| 2011/0088784 | A1 | 4/2011 | Meehan et al. |
| 2011/0253220 | A1 | 10/2011 | Sawaski et al. |
| 2011/0284111 | A1 | 11/2011 | Marty et al. |
| 2012/0145249 | A1 | 6/2012 | Rodenbeck et al. |
| 2012/0160349 | A1 | 6/2012 | Jonte et al. |
| 2013/0146160 | A1 | 6/2013 | Davidson et al. |

FOREIGN PATENT DOCUMENTS

| | | | |
|---|---|---|---|
| DE | 3339849 | | 5/1985 |
| DE | 4401637 | | 5/1998 |
| DE | 19815324 | | 11/2000 |
| EP | 0961067 | B1 | 12/1999 |
| JP | 63111383 | | 5/1988 |
| JP | 2000-073426 | | 3/2000 |
| JP | 2003-20703 | A | 1/2003 |
| JP | 2003-105817 | | 4/2003 |
| JP | 2003-293411 | | 10/2003 |
| JP | 2004-092023 | A | 3/2004 |
| JP | 2005-146551 | A | 6/2005 |
| JP | 2007270538 | | 10/2007 |
| KR | 10-1997-0700266 | | 1/1997 |
| KR | 10-2003-0008144 | | 1/2003 |
| KR | 10-2003-0077823 | | 10/2003 |
| KR | 200382786 | | 4/2005 |
| WO | WO 91/17377 | | 11/1991 |
| WO | WO 01/20204 | | 3/2001 |
| WO | WO 2004/094990 | | 11/2004 |
| WO | WO 2005/057086 | | 6/2005 |
| WO | WO 2006/098795 | | 9/2006 |
| WO | 2006136256 | | 12/2006 |
| WO | WO 2007/059051 | A2 | 5/2007 |
| WO | WO 2007/082301 | A2 | 7/2007 |
| WO | WO 2007/124311 | | 11/2007 |
| WO | WO 2007/124438 | | 11/2007 |
| WO | WO 2008/118402 | | 6/2008 |
| WO | WO 2008/088534 | | 7/2008 |
| WO | WO 2008/094246 | | 8/2008 |
| WO | WO 2008/094247 | | 8/2008 |
| WO | WO 2008/094651 | A1 | 8/2008 |
| WO | WO 2009/075858 | | 6/2009 |
| WO | WO 2011/133665 | | 10/2011 |

OTHER PUBLICATIONS

TOTO® Products, "Self-Generating EcoPower System Sensor Faucet, Standard Spout," Specification Sheet, Nov. 2002, 2 pgs.

ZURN® Plumbing Products Group, "AquaSense® Z6903 Series", Installation, Operation, Maintenance and Parts Manual, Aug. 2001, 5 pgs.

ZURN® Plumbing Products Group, "AquaSense® Sensor Faucet," Jun. 9, 2004, 2 pgs.

SLOAN® Optima® i.q. Electronic Hand Washing Faucet, Apr. 2004, 2 pgs.

Symmons®, "Ultra-Sense® Battery-Powered, Sensor-Operated Lavatory Faucet S-6080 Series," Oct. 2002, 4 pgs.

Symmons® Commercial Faucets: Reliability With a Sense of Style, 1 pg.

Symmons®, "Ultra-Sense® Sensor Faucets with Position-Sensitive Detection," Aug. 2004, 4 pgs.

(56) References Cited

OTHER PUBLICATIONS

Technical Concepts International, Inc., Capri AutoFaucet® with Surround Sensor™ Technology, 500556, 500576, 500577, (undated), 1 pg.
Technical Concepts, AutoFaucet® with "Surround Sensor" Technology, Oct. 2005, 4 pgs.
Camacho et al., Freescale Semiconductor, "Touch Pad System Using MC34940/MC33794 E-Field Sensors," Feb. 2006, 52 pgs.
Philipp, "Tough Touch Screen," applicanceDESIGN, Feb. 2006, pp. 14-17.
Quantum Research Group, "E401 User Manual," at least as early as Oct. 22, 2007, 15 pgs.
Quantum Research Group, "Gorenje Puts QSlideTM Technology into Next-Generation Kitchen Hob," Feb. 8, 2006, http://www.qprox.com/news/gorenje.php, 3 pgs.
Quantum Research Group, "Qprox™ Capacitive Touch Applications," at least as early as Oct. 22, 2007, http://www.qprox.com/background/applications.php, 8 pgs.
Quantum Research Group, "QT401 QSlide™ Touch Slider IC," 2004, 16 pgs.
Quantum Research Group, "QT411-ISSG QSlide™ Touch Slider IC," 2004-2005, 12 pgs.
Sequine et al., Cypress Perform, "Application Note AN2292, Layout Guidelines for PSoC™ CapSense™" Oct. 31, 2005, 15 pgs.
Sequine et al., Cypress Perform, "Application Notes AN2233a, Capacitive Switch Scan" Apr. 14, 2005, 6 pgs.
Symmons, Ultra-Sense, Battery-Powered Faucets with PSD and Ultra-Sense AC Powered Faucets, © 1999-2004, 2 pgs.
Various Products (available at least before Apr. 20, 2006), 5 pgs.
Symmons®, "Ultra-Sense® Sensor Faucets with Position-Sensitive Detection," © 2001-2002, 2 pgs.
Hego WaterDesign, "Touch Faucets—Amazing Futuristic Faucet Designs", Oct. 6, 2009, 3 pgs.
Dave Van Ess, Capacitive Sensing Builds a Better Water-Cooler Control, Cypress Semiconductor Corp., Nov. 2007.
Aviation Faucet System, Product Brochure, Franke Aquarotter GmbH, downloaded Oct. 1, 2012.
Springking Industry Col, Limited, Touch Sensor Faucet, Product Specification, copyright 2010 downloaded Oct. 1, 2012.
PCT International Search Report and Written Opinion, International Application No. PCT/US2013/037384, dated Jul. 25, 2013, 9 pgs.

* cited by examiner

FAUCET INCLUDING A PULLOUT WAND WITH A CAPACITIVE SENSING

CROSS-REFERENCE TO RELATED APPLICATION

The present application claims priority to U.S. provisional patent application Ser. No. 61/636,373, filed Apr. 20, 2012, the disclosure of which is expressly incorporated by reference herein.

BACKGROUND AND SUMMARY OF THE INVENTION

The present invention relates generally to electronic faucets. More particularly, the present invention relates to capacitive sensing systems and methods for operating a faucet.

It is known to provide faucets with pullout sprayheads or wands fluidly connected to flexible water supply tubes and releasably coupled to a delivery spout. Such pullout wands often provide multiple delivery modes including a spray mode and a stream mode. In the spray mode, water is discharged from a plurality of outlets in a spray pattern. In the stream mode, water is discharged in a single, relatively concentrated stream.

It is also known to provide electronic faucets to control water flow. Some electronic faucets provide capacitive sensing to control water flow where a capacitive sensor is coupled to the delivery spout and/or a manual valve handle. For example, an illustrative capacitive sensing faucet permits a user to turn water flow on and off by merely tapping the spout. The faucet may distinguish between a tap on the spout to turn the water flow on and off, and a longer grasping or grab of the spout, for example, to swing it from one basin of a sink to another. Such a faucet may also utilize the manual valve handle for touch control, which illustratively distinguishes between a grasping or grab of the handle to adjust water flow rate and/or temperature, and merely tapping the handle to toggle water flow off or on. Such an illustrative faucet is detailed in U.S. Patent Application Publication No. 2010/0170570, the disclosure of which is expressly incorporated by reference herein.

According to an illustrative embodiment of the present disclosure, an electronic faucet includes a spout hub, a manual valve handle operably coupled to the spout hub, and a pullout wand removably supported by the spout hub. A passageway conducts water through the hub to the pullout wand. An electrically operable valve is fluidly coupled to the passageway, and a manual valve is fluidly coupled to the passageway in series with the electrically operable valve, wherein the manual valve handle controls the manual valve. A controller controls operation of the electrically operably valve and is electrically coupled to the manual valve handle of the faucet. The spout hub is capacitively coupled to the manual valve handle, and the pullout wand is capacitively coupled to the spout hub when docked with the spout hub. As such, the pullout wand is touch sensitive when docked with the spout hub.

According to another illustrative embodiment of the present disclosure, an electronic faucet includes a spout hub and a pullout wand removably supported by the spout hub. The pullout wand is movable from a docked position coupled with the spout hub and an undocked position removed from the spout hub. A manual valve includes a handle and is operably coupled to the spout hub. An electrically operable valve is in fluid communication with the manual valve. A tube is slidably received within the spout hub and fluidly couples the pullout wand to the electrically operable valve. A capacitive sensor is in electrical communication with the pullout wand when in the docked position. A controller is in electrical communication with the capacitive sensor. The pullout wand is touch sensitive when in the docked position and is not touch sensitive when in the undocked position.

According to a further illustrative embodiment of the present disclosure, an electronic faucet comprises a delivery spout including a receiver. A pullout wand is movable from a docked position coupled with the receiver of the delivery spout and an undocked position removed from the receiver of the delivery spout. A wand capacitive coupling is provided between the pullout wand and the delivery spout when the pullout wand is in the docked position. A capacitive sensor is in electrical communication with the pullout wand through the wand capacitive coupling.

According to another illustrative embodiment of the present disclosure, an electronic faucet includes a delivery spout including a receiver. A pullout wand is movable from a docked position coupled with the receiver of the delivery spout and an undocked position removed from the receiver of the delivery spout. A capacitive sensor is operably coupled to the pullout wand. The output from the capacitive sensor provides an indication of at least one of touching the pullout wand when in the docked position, and a change between the docked position and the undocked position of the pullout wand. Water flow through the pullout wand is controlled based upon the output from the capacitive sensor.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
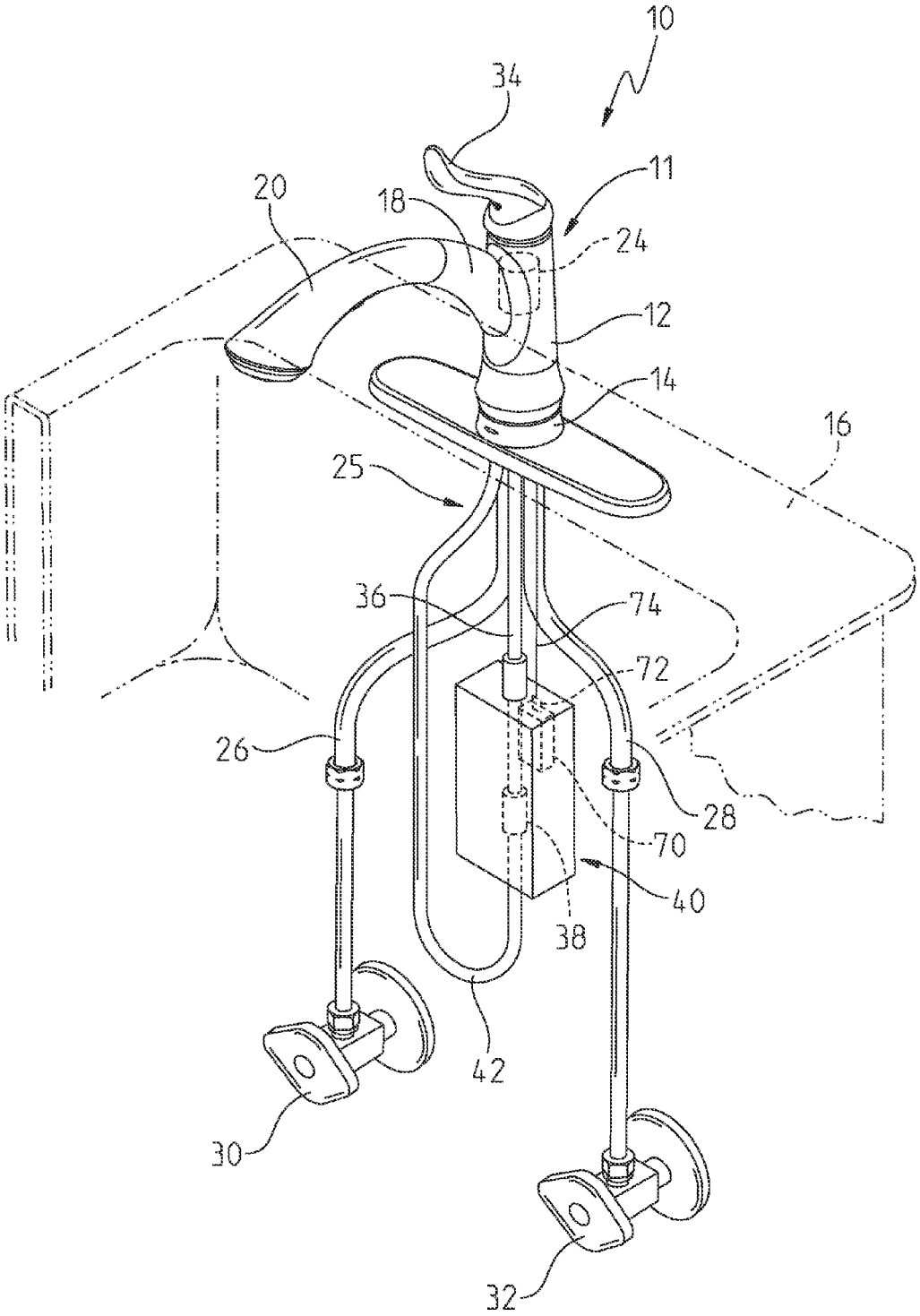
FIG. 1 is a perspective view of a faucet of the present disclosure supported by a sink deck, the faucet including a pullout wand shown in a docked position.
Figure 2:
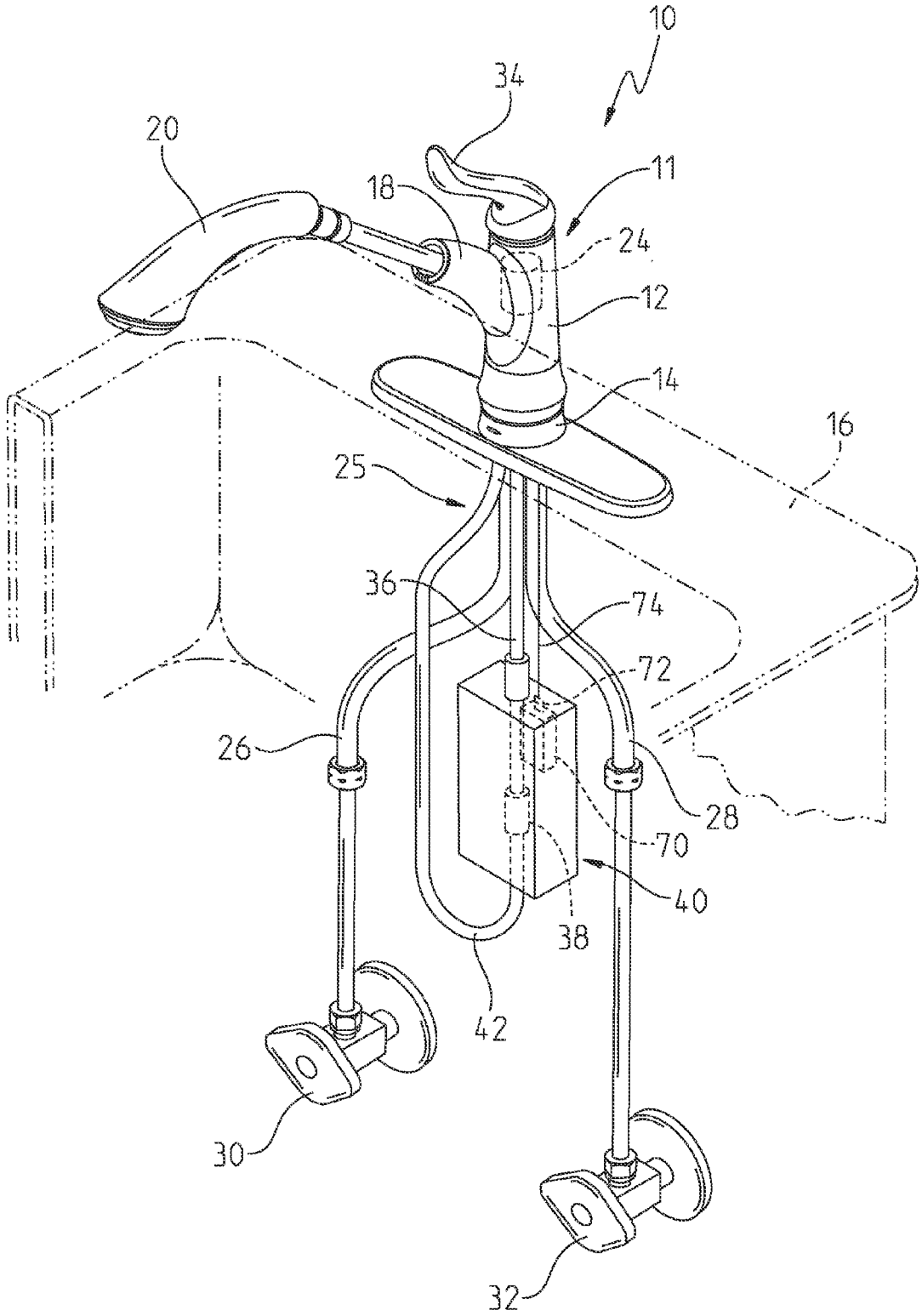
FIG. 2 is a perspective view of the faucet of FIG. 1, with the pullout wand shown in a removed or undocked position relative to the delivery spout hub.
Figure 4:
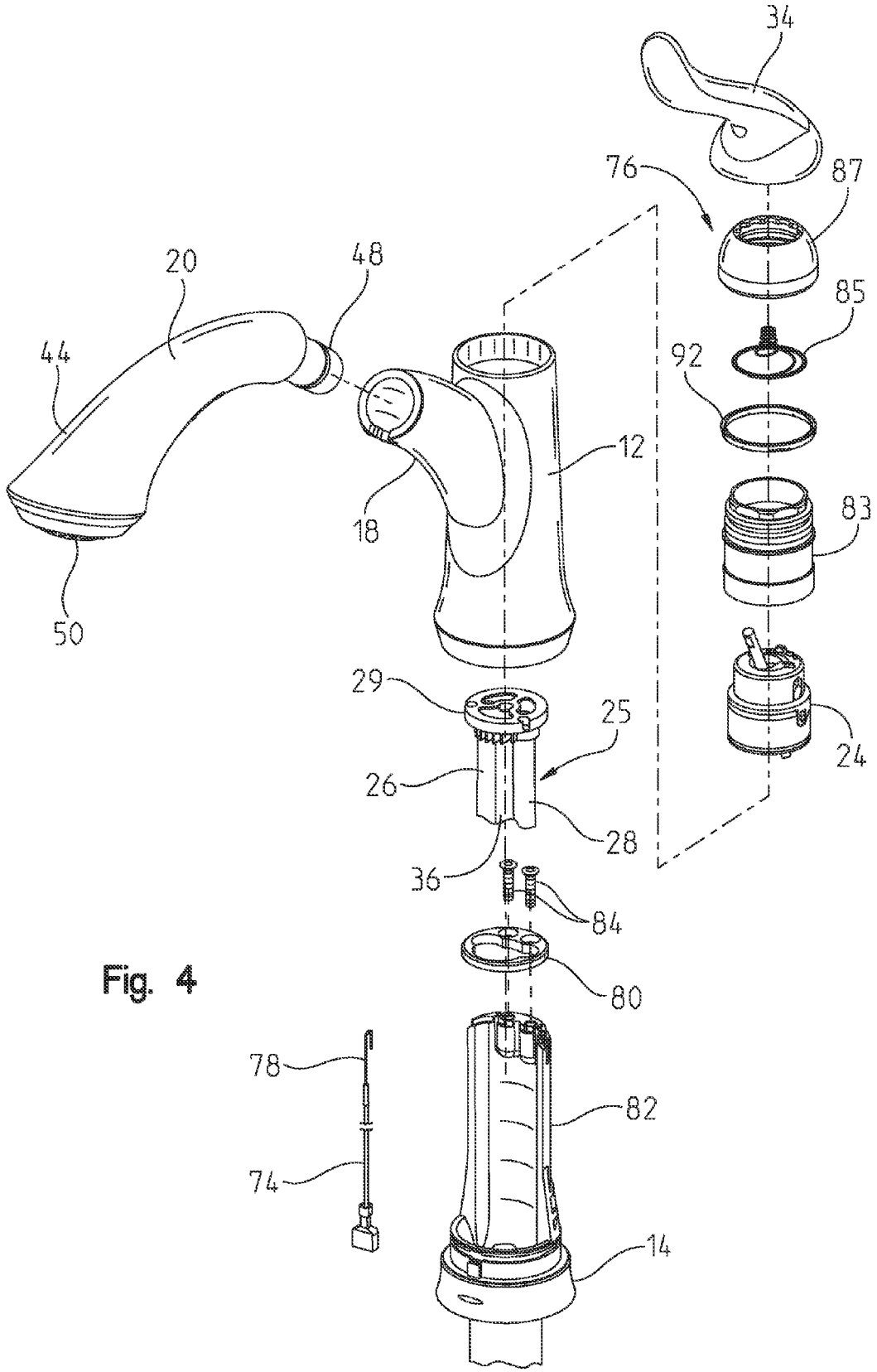
FIG. 4 is an exploded perspective view of the faucet of FIG. 1.

Referring initially to FIGS. 1 and 2, an illustrative faucet 10 is shown as including a delivery spout 11 having a hub 12 rotatably supported above a pedestal 14 coupled to a sink deck 16. The delivery spout hub 12 includes an outlet or receiver 18 removably receiving a pullout wand 20. A manual valve, illustratively a mixing valve 24, is supported by the delivery spout hub 12. A waterway assembly 25 is fluidly coupled to the mixing valve 24 and includes a hot water inlet conduit 26 and a cold water inlet conduit 28 coupled to a base 29 (FIG. 4). The hot water inlet conduit 26 is fluidly coupled to a hot water supply 30, illustratively a hot water stop, and the cold water inlet conduit 28 is fluidly coupled to a cold water supply 32, illustratively a cold water stop. Additional details of an illustrative waterway assembly 25 are provided in U.S. Pat. No. 7,766,043, the disclosure of which is expressly incorporated by reference herein. The mixing valve 24 may be controlled by a user interface, such as a manual valve handle 34, to control the flow rate and temperature of water supplied by the hot and cold water inlet conduits 26 and 28 to an outlet conduit 36. Additional details of an illustrative mixing valve 24 are provided in U.S. Pat. No. 7,753,074, the disclosure of which is expressly incorporated by reference herein.

Figure 3:
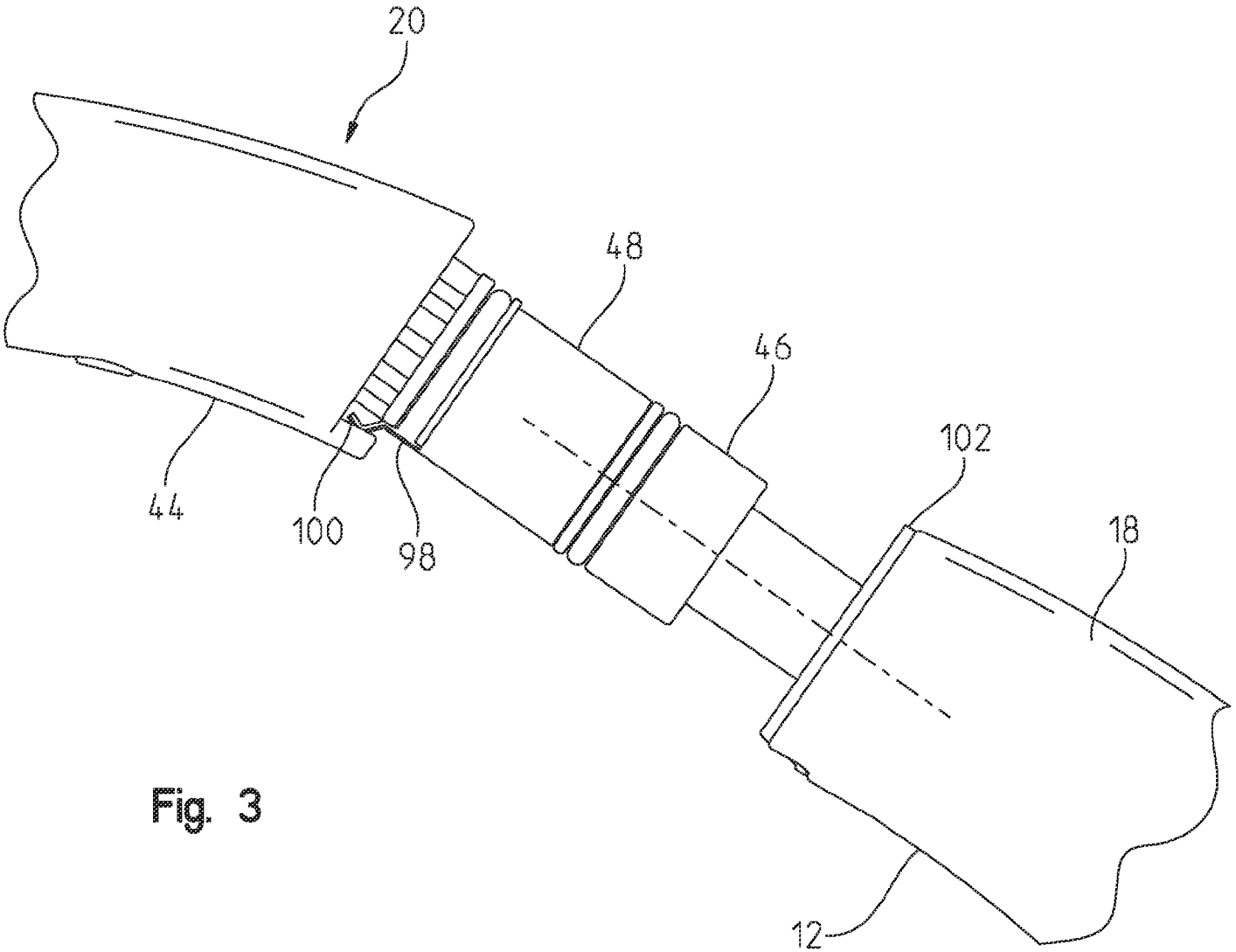
FIG. 3 is a detailed perspective view of FIG. 2, showing the pullout wand removed from the delivery spout hub.

An outlet conduit 36 is illustratively coupled to the base 29 of the waterway assembly 25 and is fluidly coupled to an actuator driven, illustratively electrically operable valve 38, positioned within a control unit 40 positioned below the sink deck 16. A flexible inlet tube 42 fluidly couples the pullout wand 20 to the actuator driven valve 38. The flexible inlet tube 42 defines a water passageway for delivering water through the spout hub 12 to the pullout wand 20. Further, the flexible inlet tube 42 is slidably received within the spout hub 12 to permit movement of the pullout wand 20 from a docked position (FIG. 1) to an undocked position (FIGS. 2 and 3). In the docked position, the pullout wand 20 is supported within the receiver 18 of the spout hub 12. In the undocked position, the pullout wand 20 is in spaced relation to the receiver 18 of the spout hub 12.

While the following description details a pullout wand 20 removably coupled to a delivery spout 11 for illustrative purposes, it should be appreciated that the present invention may find equal applicability with other fluid delivery devices, including with side sprayers typically used with kitchen faucets having delivery spouts mounted separately on the sink deck 16.

Figure 8:
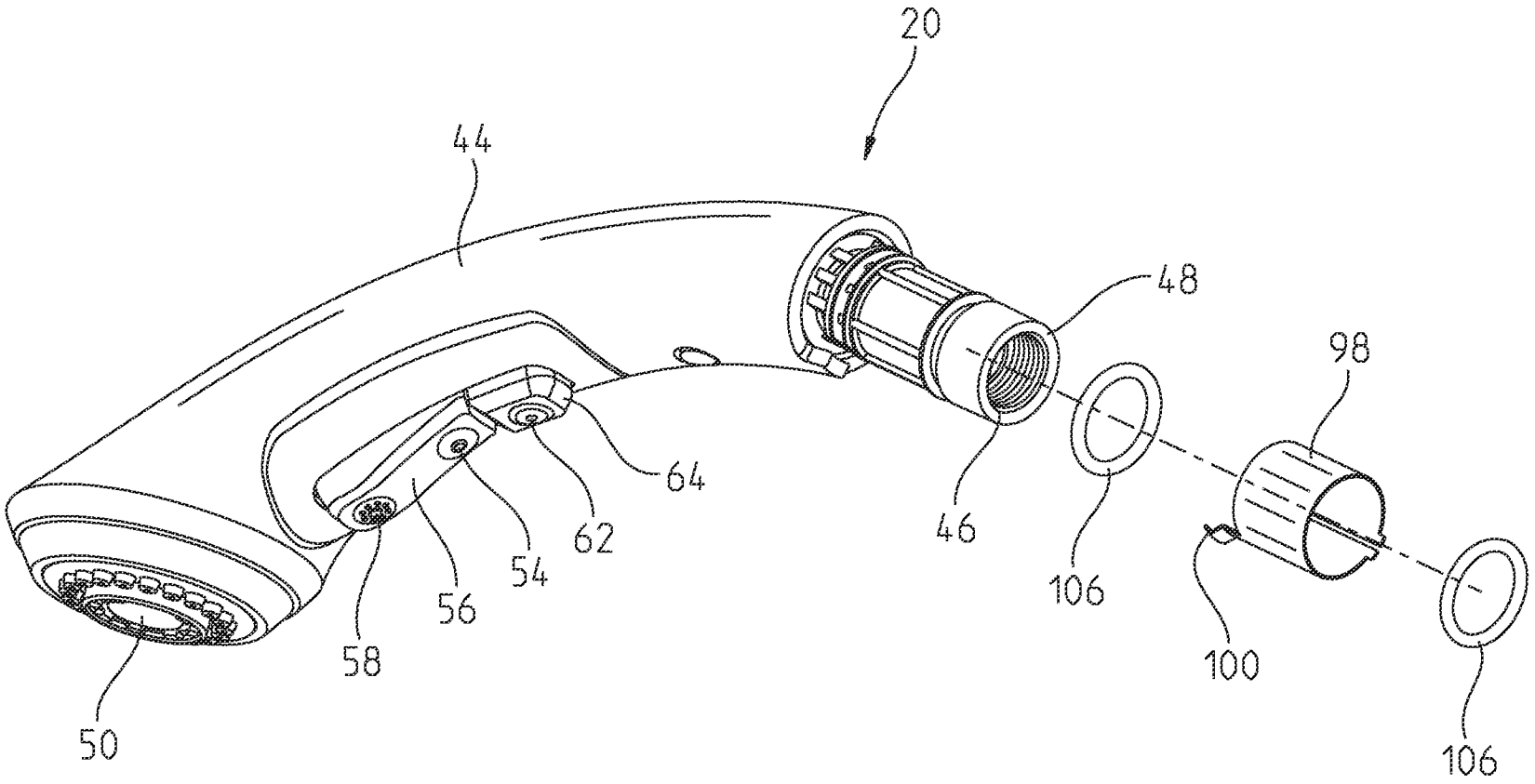
FIG. 8 is a partially exploded perspective view of the pullout wand of the faucet of FIG. 1.
Figure 9:
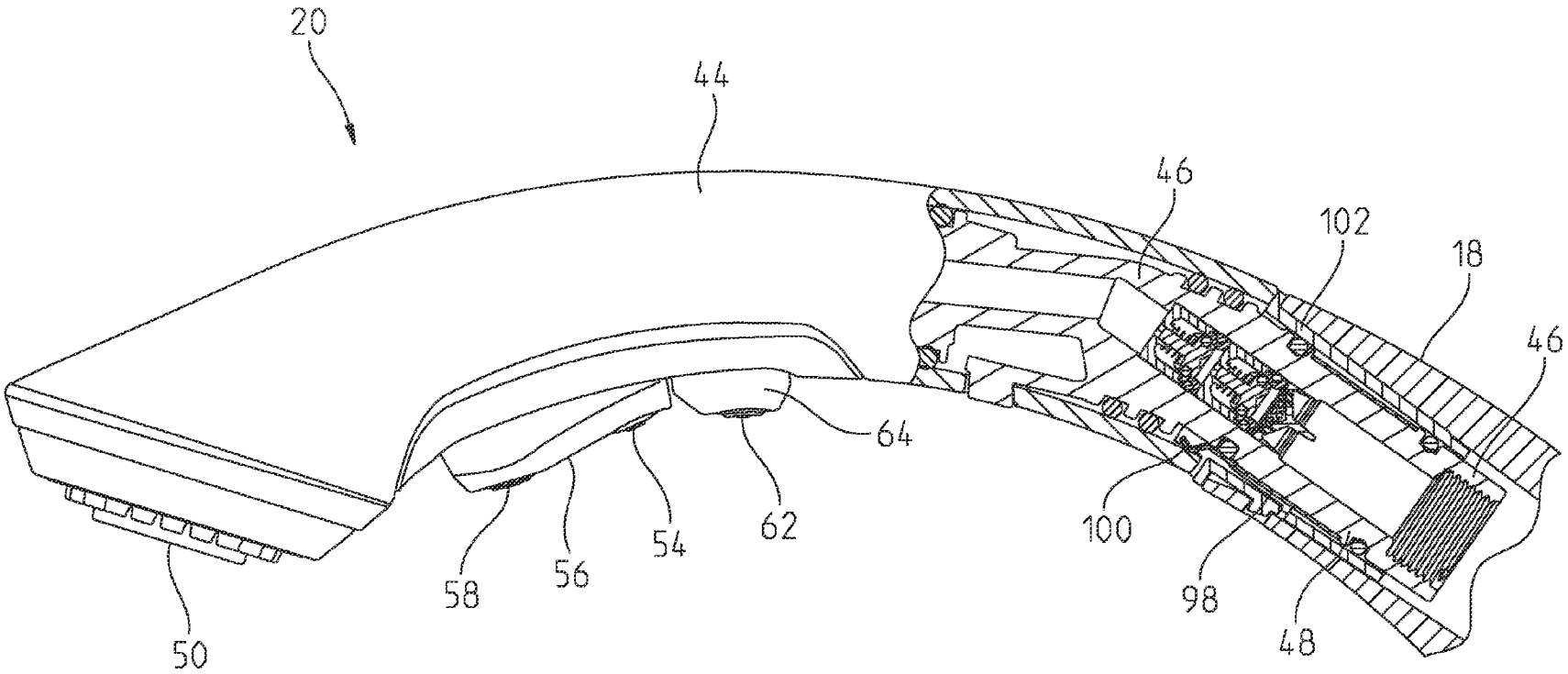
FIG. 9 is a side elevational view in partial cross-section of the pullout wand of FIG. 8, showing the capacitive coupling of the wand.

With reference to FIGS. 4, 8 and 9, the pullout wand 20 illustratively includes a shell 44 receiving a waterway 46. The waterway 46 is illustratively formed of a polymer and includes an inlet or connector 48 fluidly coupled to the inlet tube 42. Fasteners, such as screws (not shown), may couple the waterway 46 to the shell 44. The inlet 48 may include internal threads configured to be fluidly coupled with an outlet coupling (not shown), such as external threads, of the inlet tube 42. An aerator 50 may be supported at an outlet end of the waterway 46. The shell 44 has an electrically conductive outer surface, and may be formed of a metal plated polymer.

The pullout wand 20 may include a user interface defined by a first input portion 54 proximate a first end of a rocker switch 56, and a second input portion 58 proximate a second end of the rocker switch 56. Depressing the first input portion 54 causes the pullout wand 20 to dispense an aerated stream of water. Depressing the second input portion 58 causes the pullout wand 20 to dispense a spray of water. The user interface is further defined by a third input portion 62 at a button 64. Depressing the third input portion 62 at button 64 provides an increased flow rate of water to be dispensed from the pullout wand 20.

Additional details of an illustrative pullout wand 20 are provided in US Patent Application Publication No. 2011/0088784, the disclosure of which is expressly incorporated by reference herein.

As noted above, the hot water supply 30 and the cold water supply 32 may be fluidly connected directly to the actuator driven valve 38 positioned below the sink deck 16. The actuator driven valve 38 is illustratively controlled electronically by a controller 70, also positioned within the control unit 40 below the sink deck 16. As such, the flow of water through the faucet 10 may be controlled using an output from a capacitive sensor 72.

The output signal from capacitive sensor 72 may be provided to the controller 70 for controlling the actuator driven valve 38, which thereby controls flow of water to the pullout wand 20 from the hot and cold water supplies 30 and 32. By sensing capacitance changes with capacitive sensor 72, the controller 70 can make logical decisions to control different modes of operation of faucet 10, such as described in U.S. Pat. No. 7,537,023; U.S. Pat. No. 7,690,395; U.S. Pat. No. 7,150,293; U.S. Pat. No. 7,997,301; and PCT International Application Serial Nos. PCT/US08/01288 and PCT/US08/13598, the disclosures of which are all expressly incorporated herein by reference.

Figure 5:
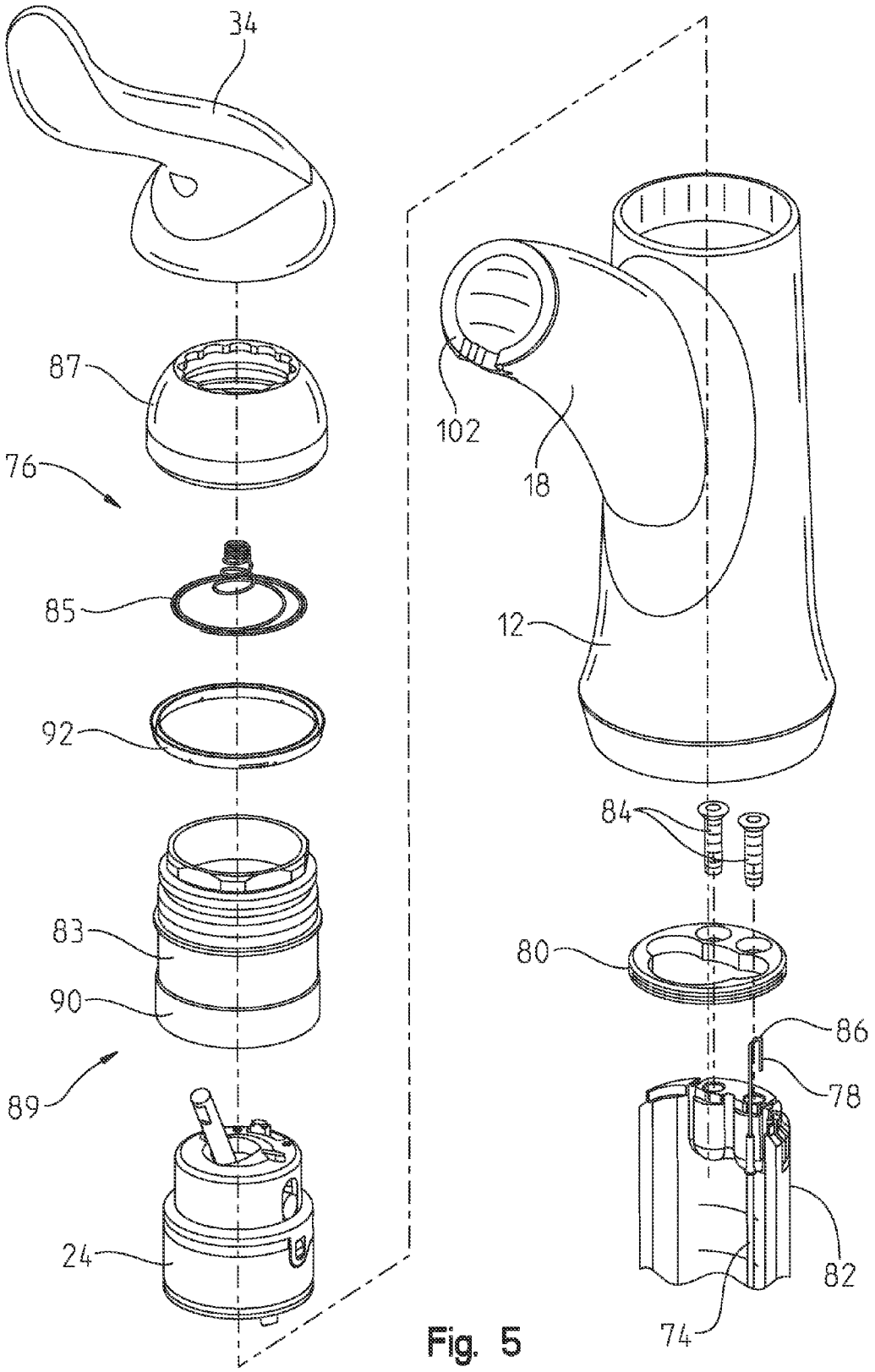
FIG. 5 is an exploded perspective view of the couplings of the handle and the delivery spout hub.
Figure 7:
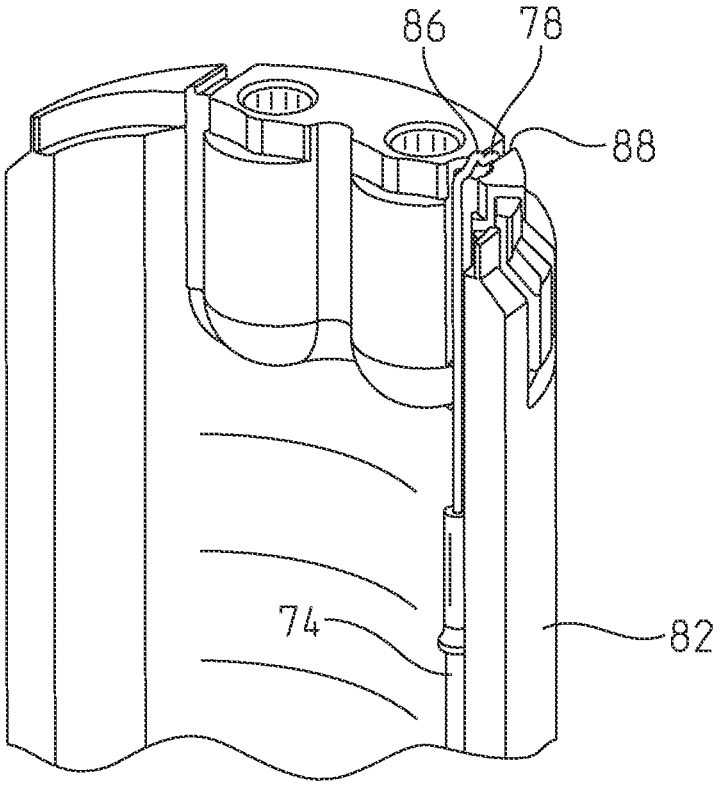
FIG. 7 is a perspective view of the sense wire support of the faucet of FIG. 1.

With reference to FIGS. 4 and 5, a sense wire or cable 74 is in electrical communication with the capacitive sensor 72, and with the manual valve handle 34 at a handle electrical coupling 76. More particularly, the sense wire 74 is electrically conductive and includes a first end connected to the controller 70, and a second end supporting a wireform 78, illustratively formed of stainless steel. The wireform 78 is in electrical communication a cap 80 supported by a waterway holder 82. The waterway holder 82 supports the waterway assembly 25 and is secured to the cap 80 by fasteners 84. As shown in FIG. 7, the wireform 78 includes a J-hook 86 that is received within a recess 88 in the holder 82 such that the wireform 78 is in electrical contact with the cap 80.

The manual valve 24 is supported by the base 29 of the waterway assembly 25 and is in fluid communication with the hot and cold water inlet conduits 26 and 28. A brass bonnet nut or sleeve 83 couples to the mixing valve 24 and includes a lower end threadably coupled to the cap 80. A contact assembly 85 extends above the mixing valve 24 and is in electrical communication with the handle 34. A bonnet cap 87 is threadably supported by an upper end of the bonnet nut 83 below the handle 34 and secures the mixing valve 24 to the bonnet nut 83. The contact assembly 85 provides electrical communication between the handle 34 and the bonnet nut 83 through the bonnet cap 87.

Figure 6:
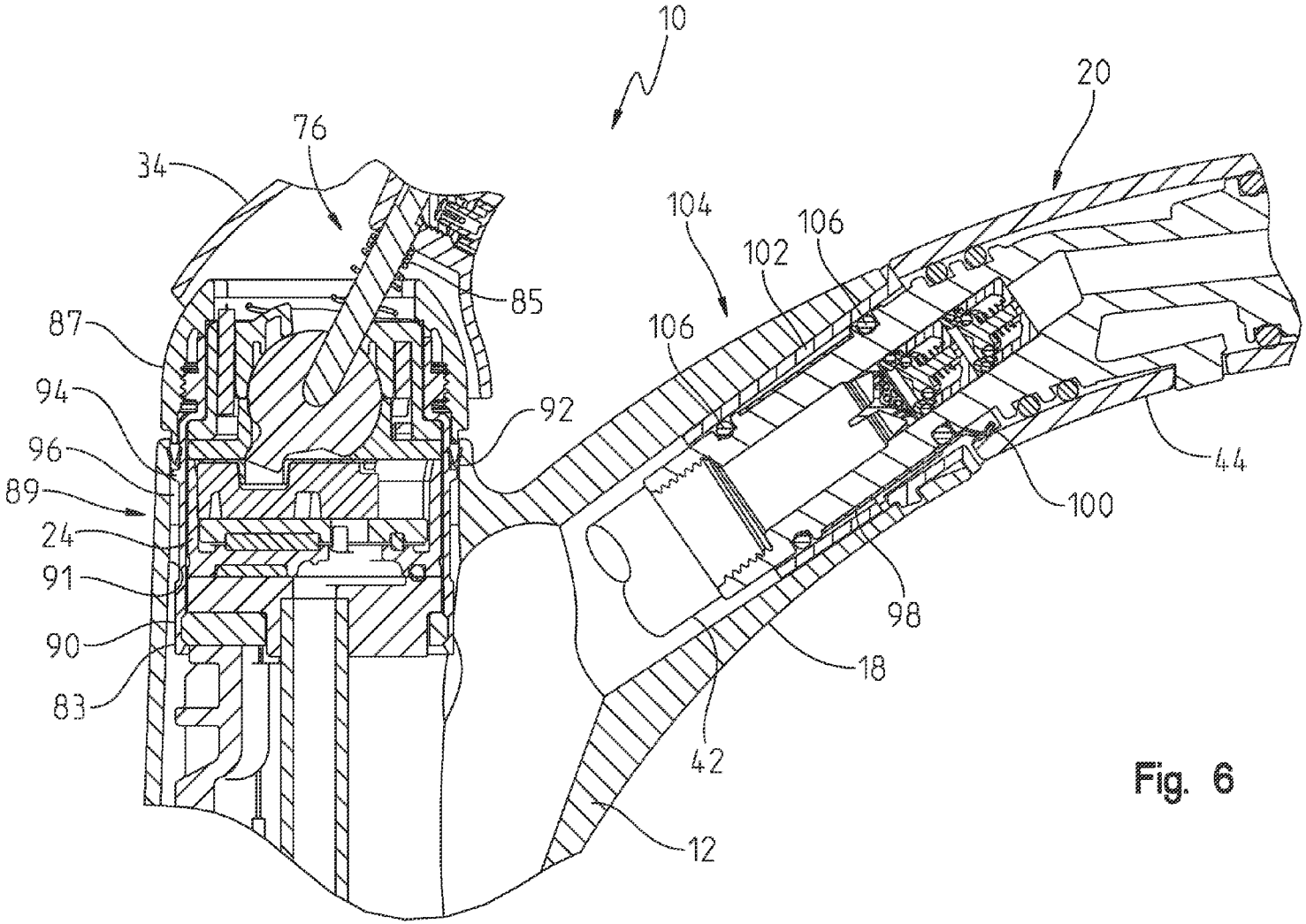
FIG. 6 is a partial cross-sectional view of the faucet of FIG. 1.

With reference to FIG. 6, the handle 34 is in electrical communication with the spout hub 12 at a hub capacitive coupling 89. More particularly, the bonnet nut 83 is concentrically received within the hub 12, such that an outer surface 90 of the bonnet nut 83 is in close proximity to an inner surface 91 of the spout hub 12. An annular seal 92 is supported by a ledge 94 on the bonnet nut 83 to provide a seal between the surfaces 90 and 91, while accommodating rotation of the hub 12 relative to the bonnet nut 83. The capacitive coupling 89 occurs over a gap 96 (illustratively around 0.012 inches) between the bonnet nut 83 and the hub 12.

With reference to FIGS. 3, 6, 8 and 9, the pullout wand 20 may be removably docked or nested within the receiver 18 of the spout hub 12. A metal sleeve 98, illustratively formed from a stamped stainless steel, is concentrically received over the inlet 48 of the waterway 46 and includes a tab 100 that contacts the outer shell 44 of the wand 20. The shell 44 is illustratively plated with a metallic coating and is in electrical communication with the sleeve 98 through the tab 100. A plastic cylindrical liner 102 is received within the spout receiver 18 intermediate an outer surface of the sleeve 98 and an inner surface of the hub 12. As such, the wand 20 is not in direct electrical contact with the hub 12 but is capacitively coupled to the hub 12 through a wand capacitive coupling 104. O-rings 106 may be supported by the inlet 48 to help secure and stabilize the wand 20 within the receiver 18.

As further detailed herein, the controller 70 in connection with the capacitive sensor 72 and associated software causes the wand 20 to be touch sensitive when docked with the hub 12. In an illustrative embodiment, when a user taps the outer shell 44 of the wand 20 when docked to the hub 12 (FIG. 1), the actuator driven valve 38 is actuated (e.g., toggled between on and off) by the controller 70. When a user grabs the outer shell 44 of the wand 20 when the wand 20 is docked to the hub 12, for example to rotate the spout hub 12 about the bonnet nut 83, the controller 70 does not alter the position or state of the actuator driven valve 38. When the wand 20 is removed or undocked from the hub 12 by a user, the controller 70 may cause the actuator driven valve 38 to open and thereby initiate water flow. In this undocked position, the wand 20 is not touch sensitive. When the wand 20 is subsequently replaced or docked within the hub 12 by the user, the controller 70 may keep the actuator driven valve 38 in its current state (e.g., open). Alternatively, the controller 70 may cause the actuator driven valve 38 to change its state (e.g., close) and thereby terminate water flow, when replaced within the hub 12.

In one illustrated embodiment, the capacitive sensor 72 is a CapSense capacitive sensor available from Cypress Semiconductor Corporation. In this illustrated embodiment, the capacitive sensor 72 converts capacitance into a count value. The unprocessed count value is referred to as a raw count. Processing the raw count signal determines whether the handle 34, hub 12 or pullout wand 20 have been touched and whether the pullout wand 20 is docked or undocked as discussed below. It is understood that other suitable capacitive sensors 72 may be used.

Figure 10:
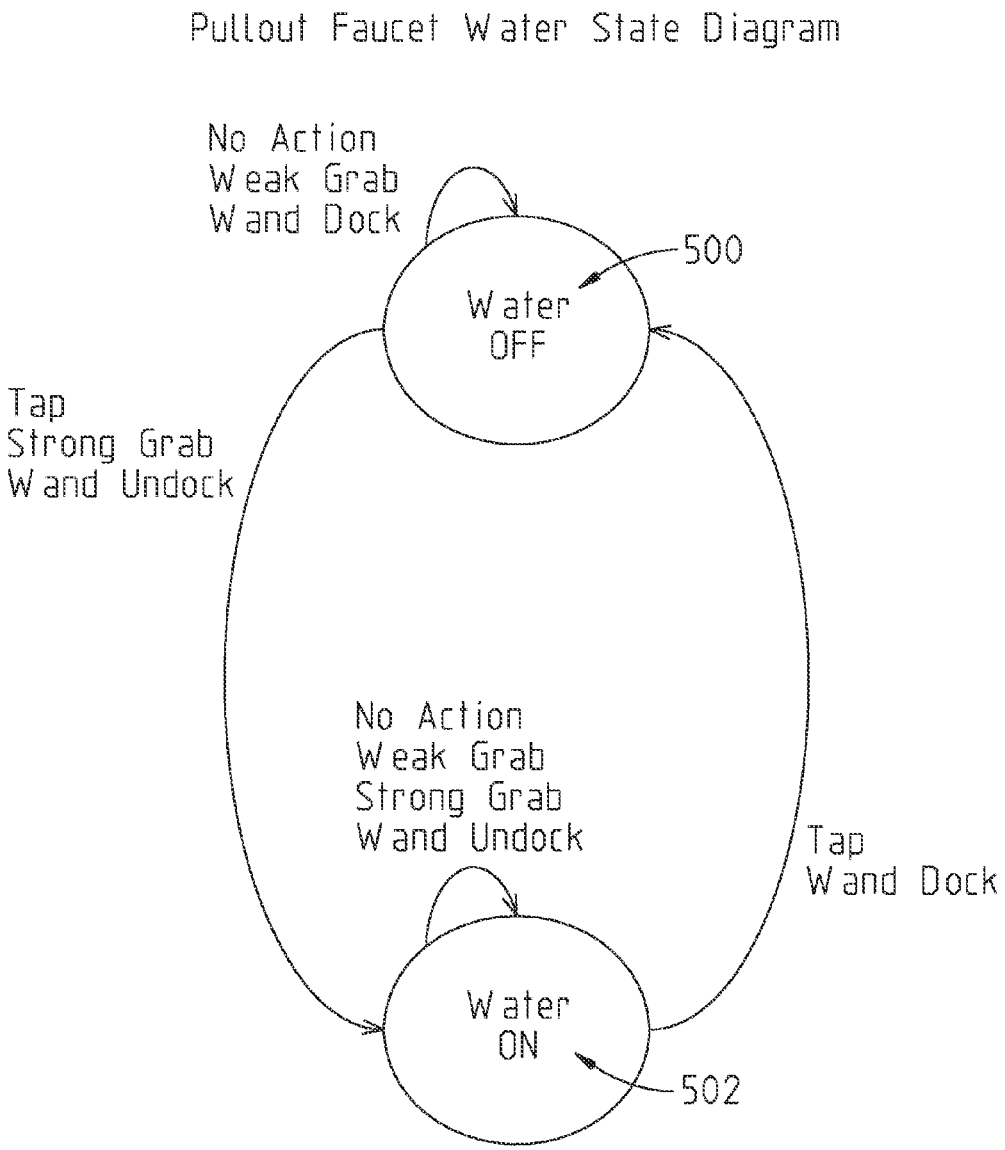
FIG. 10 is an operation state diagram illustrating control of fluid flow based on an output signal from the capacitive sensor.

FIG. 10 is an operation state diagram illustrating control of fluid flow based on the output signal from the capacitive sensor 72. The controller 70 processes the output signal from the capacitive sensor 72 to determine whether a user grabs the control handle or lever 34 of the faucet which is referred to as a "strong grab". The controller 70 also determines whether the user has grabbed the pullout wand 20 of the faucet which is referred to herein as a "weak grab". In addition, the controller 70 determines whether the handle 34, the hub 12, or the pullout wand 20 has been tapped by the user. Taps have a shorter time duration than grabs and control operation differently.

In an illustrated embodiment, a tap of any of the components (e.g., the handle 34, the hub 12, or the pullout wand 20) by the user will change the state of fluid flow. A weak grab where the user grabs onto the pullout wand 20 will not change the fluid flow state. Referring now to FIG. 10, if the water is off as illustrated at block 500, the controller 70 will take no action if a weak grab of the pullout wand 20 is detected with the wand 20 in a docked position. When the water is off block 500, the controller 70 will change the state and turn the water on if a tap of any faucet component (e.g., the handle 34, the hub 12, or the pullout wand 20) is detected, if a strong grab of the handle 34 is detected, or if undocking of the pullout wand 20 is detected.

Once the water is on as illustrated at block 502, the controller 70 takes no action and keeps the water on if it detects either a weak grab of the pullout wand 20, a strong grab of the control handle 34, or that the wand 20 is undocked. The controller 70 will change the water flow state and turn the water off upon detecting a tap of any of the faucet components including the handle 34, the hub 12, or the pullout wand 20. The controller 70 will also turn the water off upon detecting that the pullout wand 20 is docked indicating that the user has replaced the pullout wand 20 into the receiver 18.

FIGS. 11-16 show exemplary output signal plots from the capacitive sensor 72. Controller 70 establishes an upper "grab" threshold level and a lower "tap" threshold level above a signal baseline level 510 as illustrated in FIGS. 11-16. The tap threshold 512 is set as low as possible in order to avoid false activations due to noise, interference, etc. The grab threshold 514 varies depending upon the particular faucet and sink components. Therefore, the grab threshold 514 is determined by an analysis of each faucet model. The controller 70 distinguishes between a "tap" and a "grab" of the handle 34 or pullout wand 20 based on the amplitude of the capacitive signal and an amount of time between the positive and negative slopes of the capacitive signal. Illustratively, a "grab" is a touch lasting longer than 0.3 seconds in one embodiment.

Figure 11:
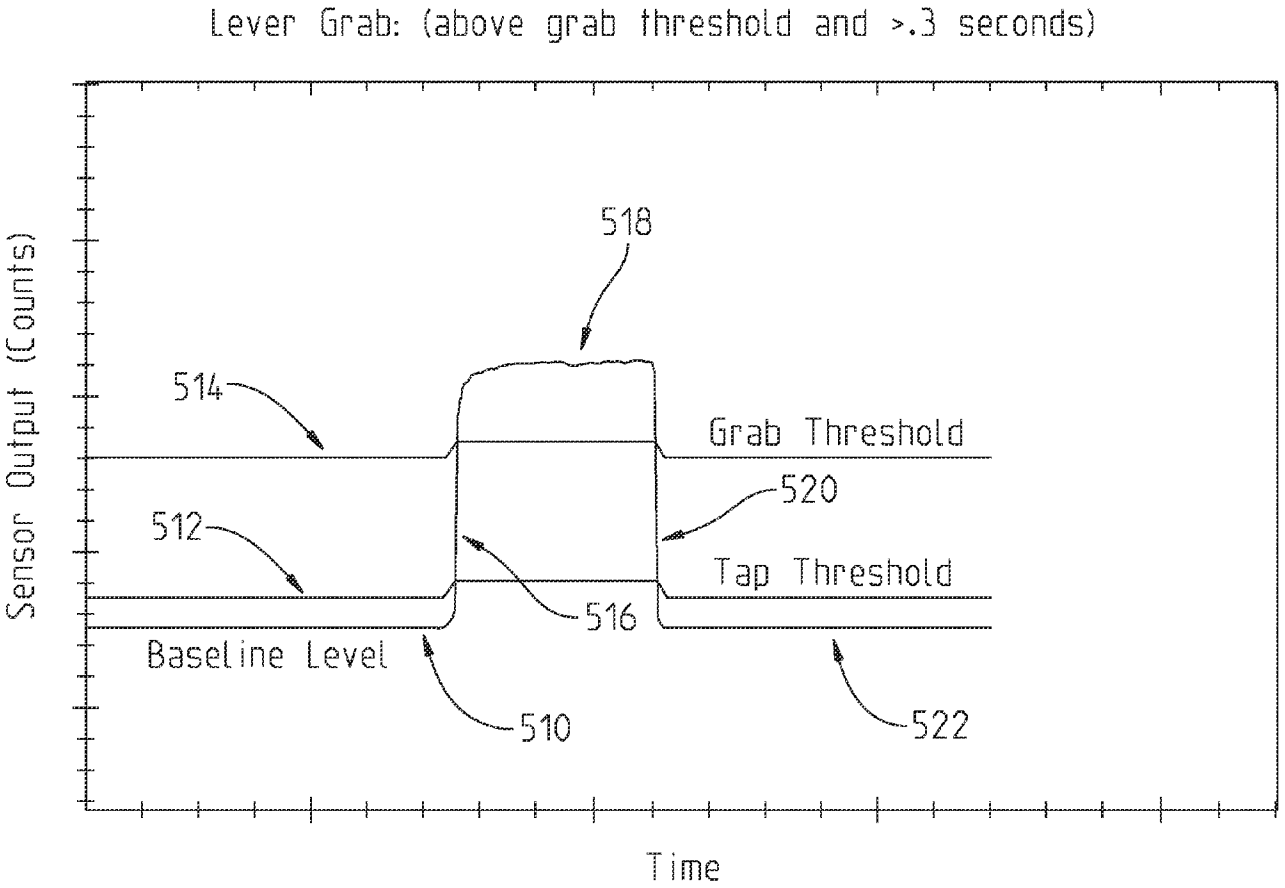
FIG. 11 illustrates an exemplary capacitive sensor output signal plot in response to a user grabbing a control lever or handle.

FIG. 11 illustrates an output signal from the capacitive sensor 72 when the control lever or handle 34 of the faucet is grabbed by the user. The capacitive signal has an initial baseline level 510. When the handle 34 is grabbed by the user, a large positive slope of the capacitive signal occurs at location 516. The signal during the handle 34 grab is above the grab threshold level 514 as illustrated at location 518. Once the handle 34 is released, a large negative slope 520 occurs and the signal returns to a baseline level 522 which is illustratively the same as original baseline level 510 in FIG. 11. As discussed above, the controller 70 determines that the handle 34 has been grabbed when the length of time that the signal exceeds the grab threshold 514 exceeds a preselected time period. Illustratively, if the signal exceeds the grab threshold 514 for more than 0.3 seconds, then a grab of handle 34 is detected.

Figure 12:
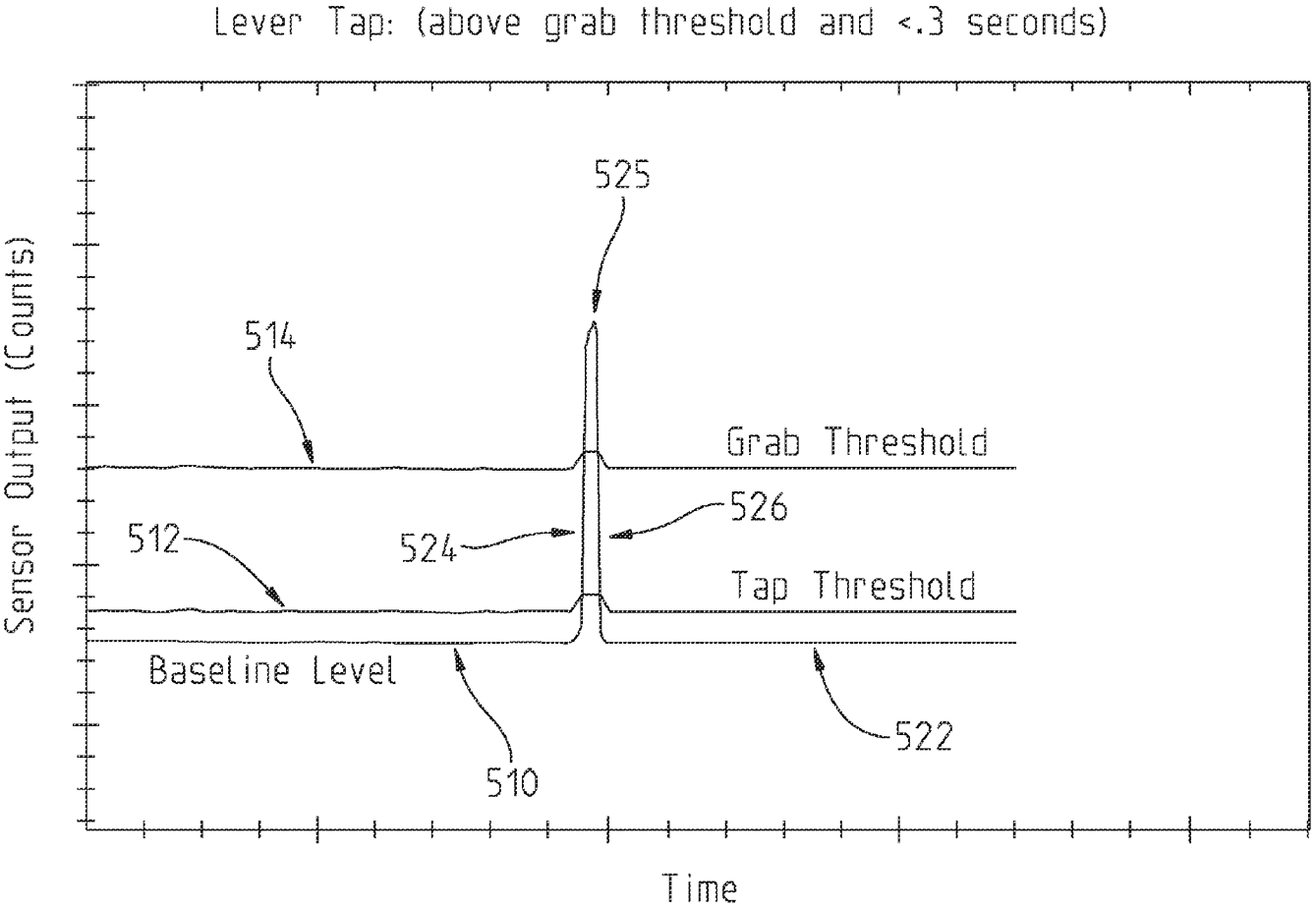
FIG. 12 illustrates an exemplary capacitive sensor output signal plot in response to a user tapping the control lever or handle.

FIG. 12 illustrates an output signal from the capacitive sensor when a tap of the control lever or handle 34 is detected. In FIG. 12, the tap causes a large positive slope to occur at location 524 and a large negative slope occurs at location 526 less than 0.3 seconds after the positive slope 524. The signal exceeds the grab threshold 514 at location 525 indicating that the handle 34 has been tapped by a user.

In an illustrated embodiment, the controller 70 also determines whether a hub 12 of the faucet has been grabbed or tapped. Plots for the hub 12 being grabbed or tapped are similar to FIGS. 11 and 12, respectfully, and with a reduction in the capacitance value of about 10% during the grab or tap time periods.

Figure 13:
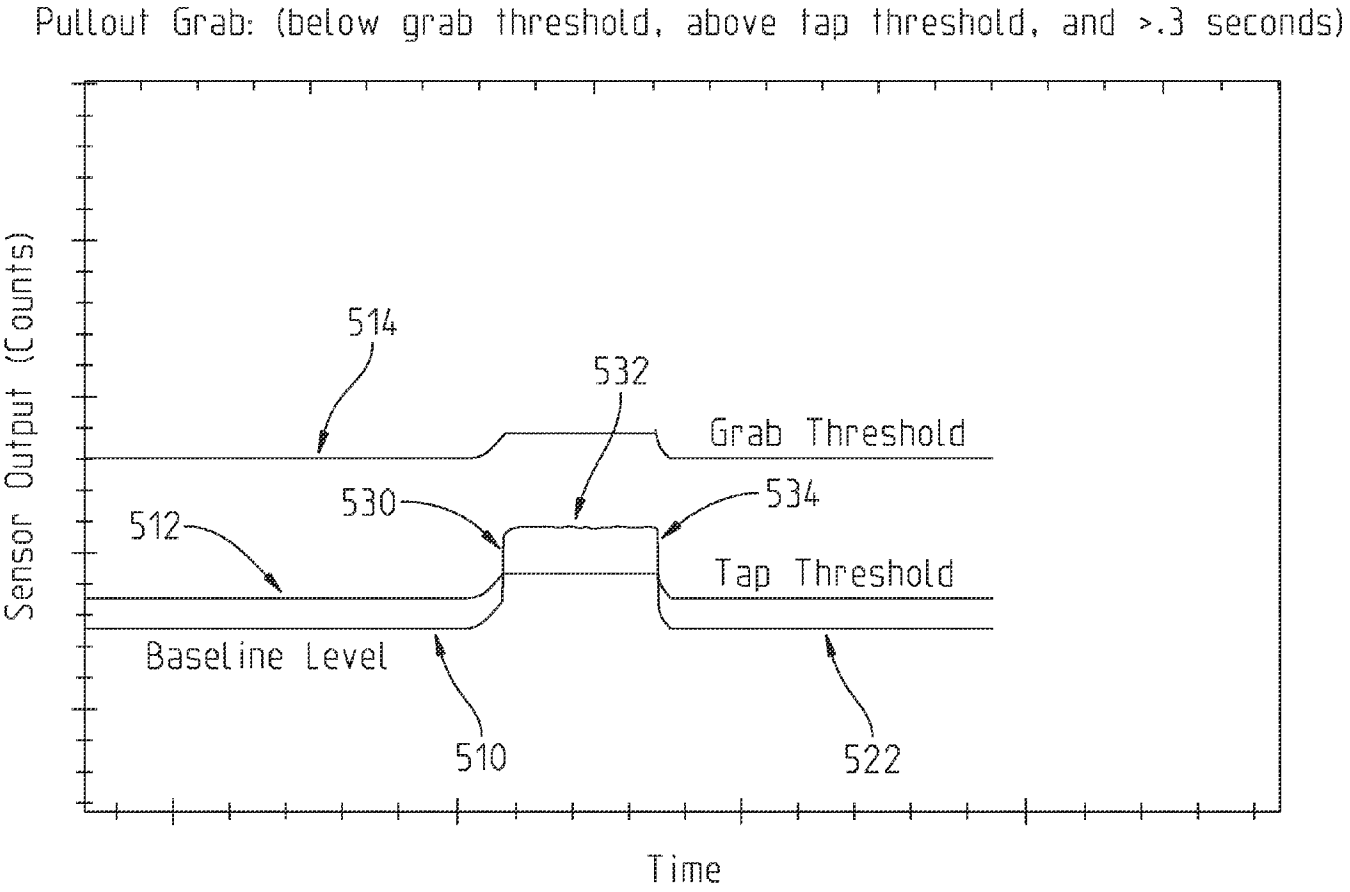
FIG. 13 illustrates an exemplary capacitive sensor output signal plot in response to a user grabbing a pullout wand.

FIG. 13 illustrates an output signal from the capacitive sensor 72 when the pullout wand 20 of the faucet is docked and grabbed by the user. The capacitive signal has an initial baseline level 510. After an initial positive slope portion 530, the capacitive signal during the pullout wand 20 grab is above the tap threshold level 512 but below the grab threshold level 514 as illustrated at location 532. Once the pullout wand 20 is released, a large negative slope 534 occurs and the signal returns to a baseline level 522 which is illustratively the same as baseline level 510 in FIG. 13. As discussed above, the controller 70 determines that the pullout wand 20 has been grabbed when the length of time that the signal exceeds the tap threshold 512 exceeds a preselected time period. Illustratively, if the signal exceeds the tap threshold 512 for more than 0.3 seconds, then a pullout wand 20 grab is detected.

Figure 14:
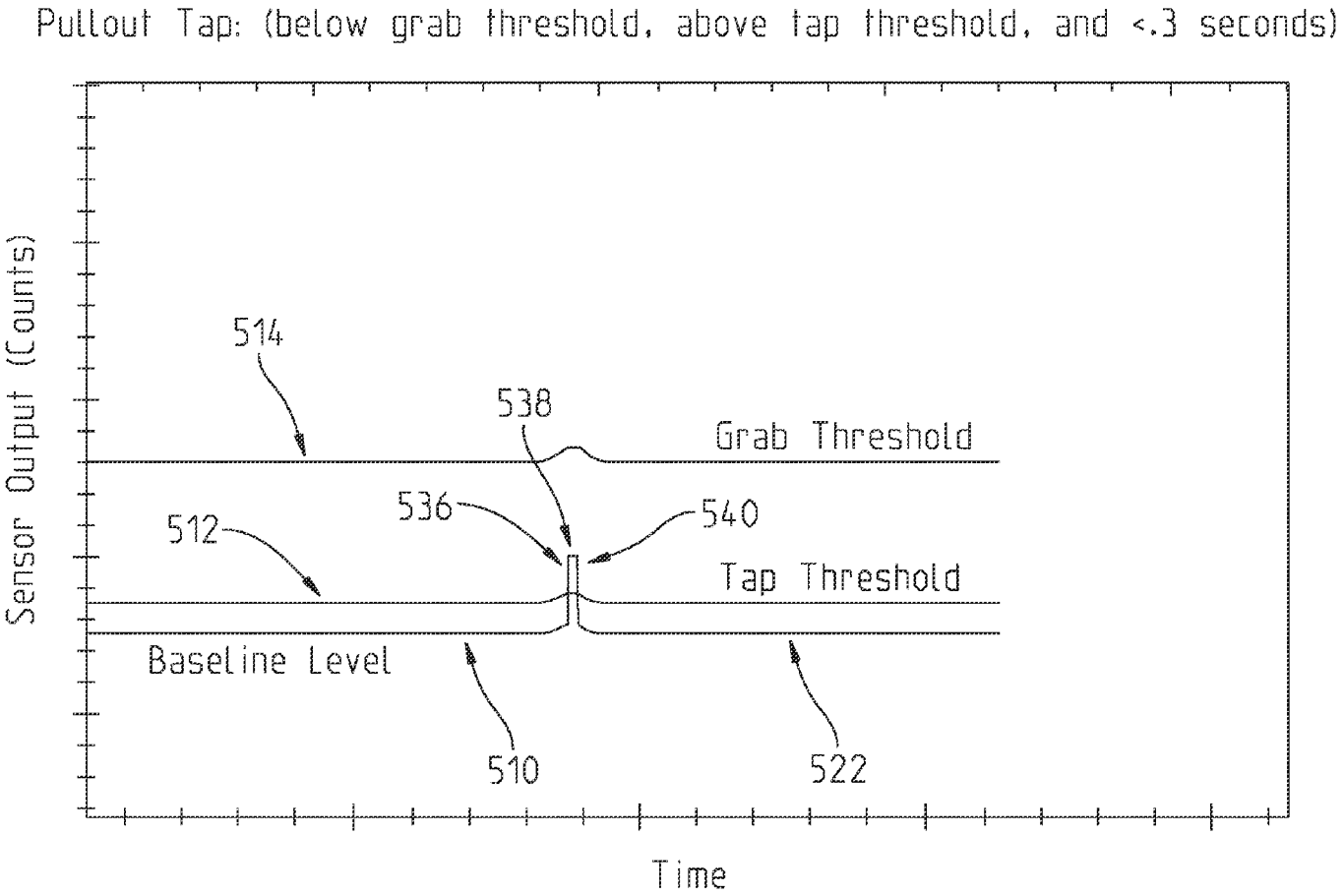
FIG. 14 illustrates an exemplary capacitive sensor output signal plot in response to a user tapping the pullout wand.

FIG. 14 illustrates an output signal block from the capacitive sensor 72 when a tap of the docked pullout wand 20 is detected. In FIG. 14, the tap occurs when the large positive slope occurs at location 536 and a large negative slope occurs at location 540 less than 0.3 seconds after the positive slope 536. The signal exceeds the tap threshold 512 at location 538, but is less than the grab threshold 514, indicating that the pullout wand 20 was tapped by a user.

Figure 15:
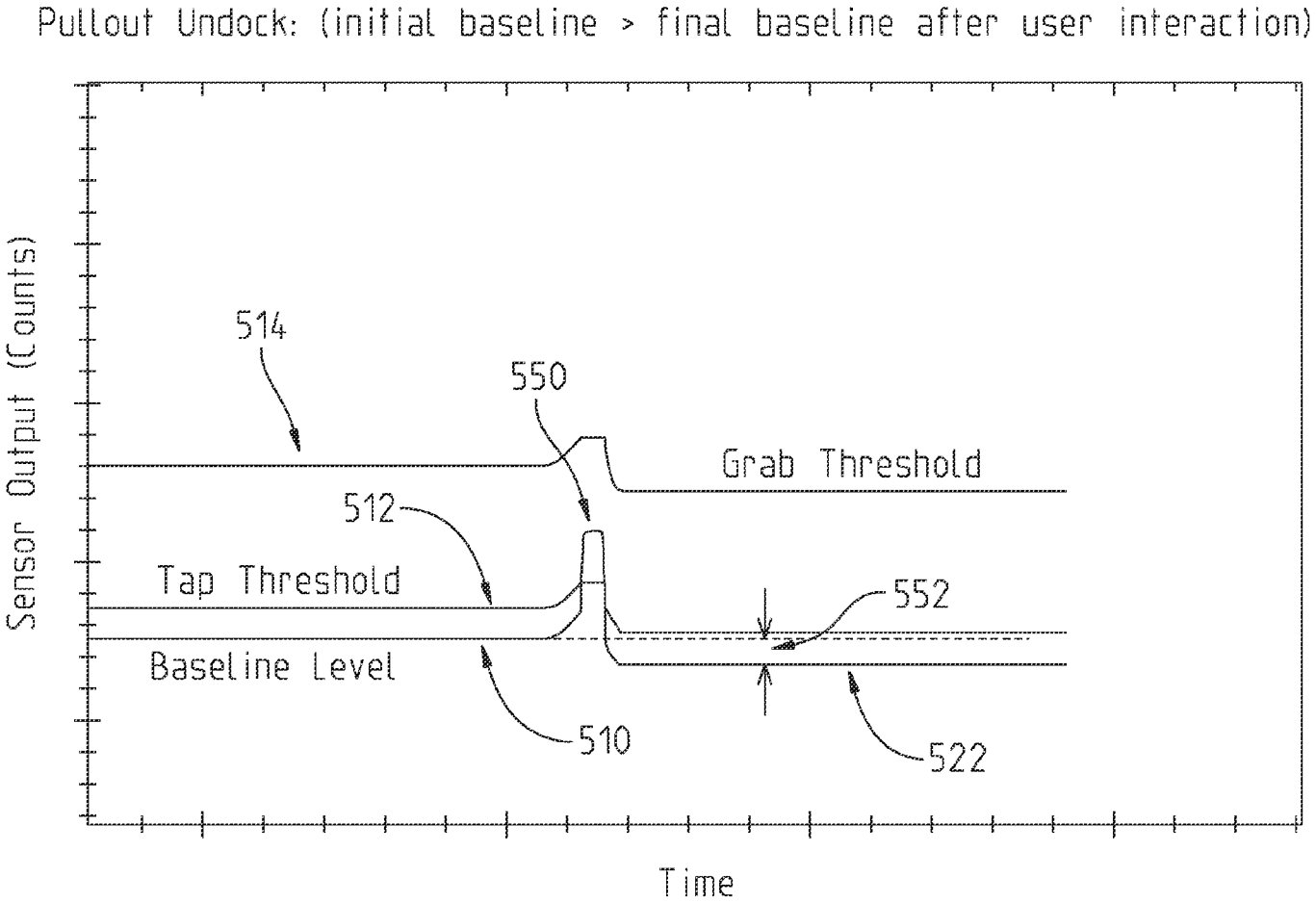
FIG. 15 illustrates an exemplary capacitive sensor output signal plot in response to a user undocking the pullout wand.

FIG. 15 illustrates the output of the capacitive sensor 72 when the pullout wand 20 is undocked from the receiver 18 of hub 12. In the illustrated embodiment, the initial baseline level 510 of the capacitive signal changes to a lower baseline level 522 after the pullout wand 20 is touched by the user and removed or undocked at location 550. The drop in the baseline level of the capacitive signal as illustrated by dimension 552 is detected by the controller 70 to determine that the pullout wand 20 has been undocked from the receiver 18 of hub 12.

Figure 16:
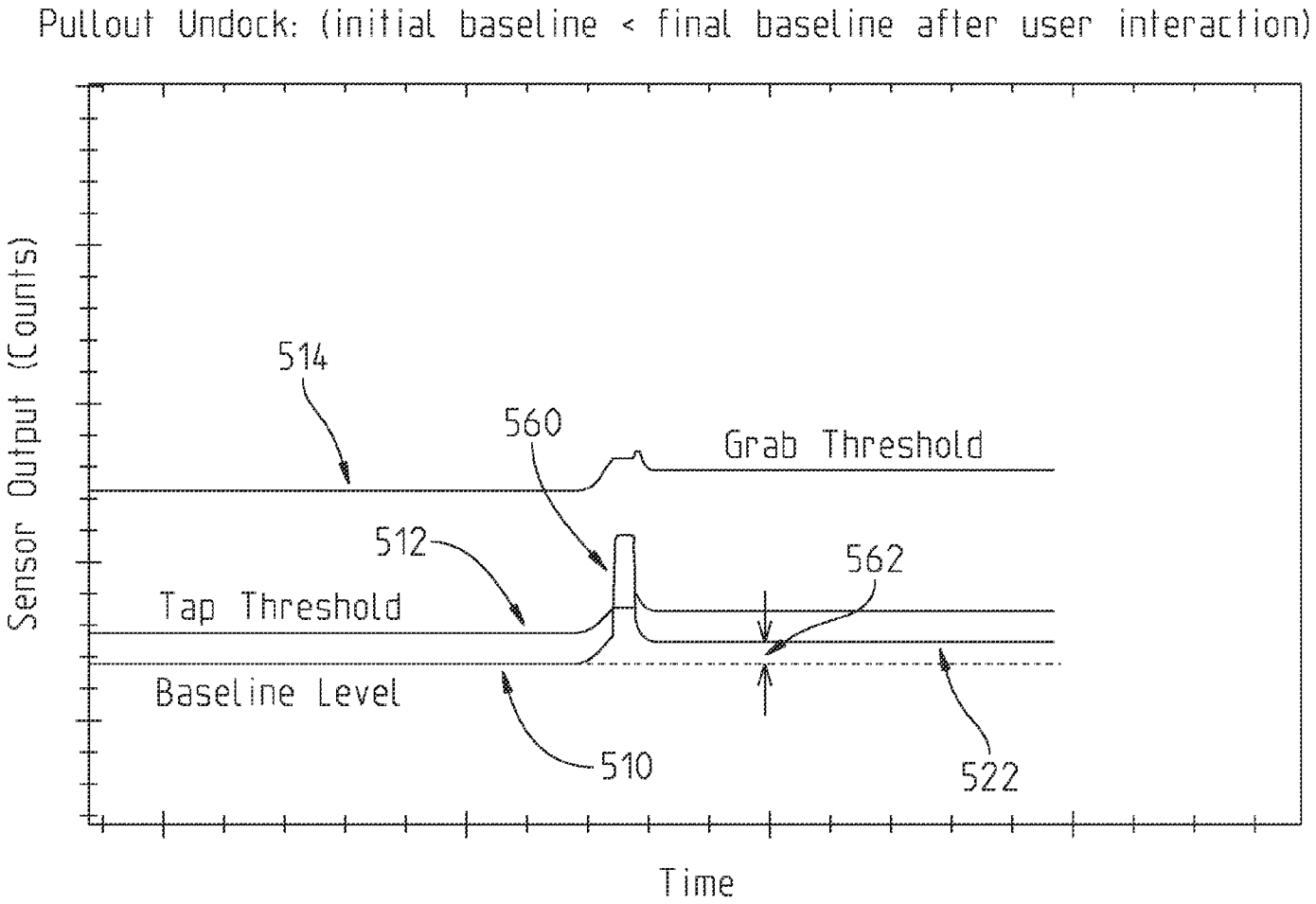
FIG. 16 illustrates an exemplary capacitive sensor output signal plot in response to a user docking the pullout wand.

FIG. 16 illustrates the output signal from the capacitive sensor 72 when the pullout wand 20 is moved from an undocked position to a docked position within the receiver 18 of hub 12. In this instance, the initial baseline signal level 510 increases to a higher baseline level 522 after the user replaces or docks the pullout wand 20 at location 560. The increase of the baseline level illustrated by dimension 562 in FIG. 16 is detected by the controller 70 to determine that the wand 20 has been docked.

Although the invention has been described in detail with reference to certain preferred embodiments, variations and modifications exist within the spirit and scope of the invention as described and defined in the following claims.

The invention claimed is:

1. An electronic faucet comprising:

a spout hub;

a pullout wand removably supported by the spout hub, the pullout wand being movable from a docked position coupled with the spout hub and an undocked position removed from the spout hub;

a manual valve including a handle operably coupled to the spout hub;

an electrically operable valve in fluid communication with the manual valve;

a tube slidably received within spout hub and fluidly coupling the pullout wand to the electrically operable valve;

a capacitive sensor in electrical communication with the pullout wand when in the docked position; and a controller in electrical communication with the capacitive sensor, wherein the pullout wand is touch sensitive when in the docked position and is not touch sensitive when in the undocked position.

2. The electronic faucet of claim 1, wherein the pullout wand is capacitively coupled to the spout hub through a wand capacitive coupling.

3. The electronic faucet of claim 2, wherein the wand capacitive coupling includes a metal sleeve supported by the pullout wand and a plastic cylindrical liner supported by the spout hub.

4. The electronic faucet of claim 2, further comprising a handle electrical coupling between the capacitive sensor and the handle of the manual valve.

5. The electronic faucet of claim 2, further comprising a hub capacitive coupling between the capacitive sensor and the spout hub.

6. The electronic faucet of claim 1, wherein the controller distinguishes between a tap of the pullout wand when in the docked position, and a grab of the pullout wand when in the docked position.

7. The electronic faucet of claim 1, wherein the controller controls operation of the electrically operable valve based upon a touching of the pullout wand when in the docked position.

8. An electronic faucet comprising:

a delivery spout including a receiver;

a pullout wand movable from a docked position coupled with the receiver of the delivery spout and an undocked position removed from the receiver of the delivery spout;

a wand capacitive coupling between the pullout wand and the delivery spout when the pullout wand is in the docked position; and a capacitive sensor in electrical communication with the pullout wand through the wand capacitive coupling.

9. The electronic faucet of claim 8, further comprising a controller in electrical communication with the capacitive sensor, wherein the pullout wand is touch sensitive when in the docked position and is not touch sensitive when in the undocked position.

10. The electronic faucet of claim 9, wherein the controller distinguishes between a tap of the pullout wand when docked and a grab of the pullout wand when docked.

11. The electronic faucet of claim 8, further comprising an electrically operable valve, and a tube slidably received within the delivery spout and fluidly coupling the pullout wand to the electrically operable valve.

12. The electronic faucet of claim 11, further comprising a manual valve including a handle operably coupled to the delivery spout and in fluid communication with the electrically operable valve.

13. The electronic faucet of claim 12, further comprising a handle electrical coupling between the capacitive sensor and the handle of the manual valve.

14. The electronic faucet of claim 11, wherein operation of the electrically operable valve is controlled based upon at least one of a touching of the pullout wand when in the docked position, and a change between the docked position and the undocked position of the pullout wand.

15. The electronic faucet of claim 8, wherein the wand capacitive coupling includes a metal sleeve supported by the pullout wand and a plastic cylindrical liner supported by the receiver of the delivery spout.

16. The electronic faucet of claim 8, further comprising a hub capacitive coupling between the capacitive sensor and the delivery spout.

17. An electronic faucet comprising:

a delivery spout including a receiver;

a pullout wand movable from a docked position coupled with the receiver of the delivery spout and an undocked position removed from the receiver of the delivery spout; and a capacitive sensor operably coupled to, and in selective electrical communication with, the pullout wand;

wherein output from the capacitive sensor provides an indication of at least one of touching the pullout wand when in the docked position, or a change between the docked position and the undocked position of the pullout wand; and wherein water flow through the pullout wand is controlled based upon the output from the capacitive sensor.

18. The electronic faucet of claim 17, wherein the pullout wand is capacitively coupled to the delivery spout through a wand capacitive coupling.

19. The electronic faucet of claim 18, wherein the wand capacitive coupling includes a metal sleeve supported by the pullout wand and a plastic cylindrical liner supported by the receiver of the delivery spout.

20. The electronic faucet of claim 17, further comprising a controller in electrical communication with the capacitive sensor, wherein the pullout wand is touch sensitive when in the docked position and is not touch sensitive when in the undocked position.

21. The electronic faucet of claim 17, further comprising an electrically operable valve and a tube slidably received within the delivery spout and fluidly coupling the pullout wand to the electrically operable valve.

22. The electronic faucet of claim 21, wherein the electrically operable valve changes state if at least one of the pullout wand is touched while in the docked position, and if the pullout wand is moved between the docked position and undocked position.

23. The electronic faucet of claim 22, wherein the controller moves the electrically operable valve from a closed position to an open position in response to at least one of a user tap of the pullout wand when in the docked position, and undocking of the pullout wand from the docked position to the undocked position.

24. The electronic faucet of claim 22, wherein the controller moves the electrically operable valve from an open position to a closed position in response to at least one of a user tap of the pullout wand when in the docked position, and docking of the pullout wand from the undocked position to the docked position.

* * * * *